US007392681B2

(12) United States Patent
Tsuritani

(10) Patent No.: US 7,392,681 B2
(45) **Date of Patent: *Jul. 1, 2008**

(54) WIRE ROD CUTTING APPARATUS OF SPRING MANUFACTURING MACHINE

(75) Inventor: Katsuhide Tsuritani, Osaka (JP)

(73) Assignee: Shinko Machinery Co., Ltd., Osaka (JP)

( * ) Notice: Subject to any disclaimer, the term of this patent is extended or adjusted under 35 U.S.C. 154(b) by 169 days.

This patent is subject to a terminal disclaimer.

(21) Appl. No.: 11/416,075

(22) Filed: May 3, 2006

(65) Prior Publication Data

US 2006/0196242 A1 Sep. 7, 2006

Related U.S. Application Data

(63) Continuation-in-part of application No. 10/847,284, filed on May 18, 2004, now Pat. No. 7,055,356.

(30) Foreign Application Priority Data

Jul. 22, 2003 (JP) ..... 2003-277223

(51) Int. Cl.
*B21F 11/00* (2006.01)

(52) U.S. Cl. ..... 72/132; 72/129; 83/907

(58) Field of Classification Search ..... 72/132, 72/135, 129; 83/907, 321, 315, 327
See application file for complete search history.

(56) References Cited

U.S. PATENT DOCUMENTS 6,178,862 B1 * 1/2001 Liao ..... 83/628

FOREIGN PATENT DOCUMENTS

JP 7-115101 12/1995
JP 8-15635 2/1996

* cited by examiner

*Primary Examiner*—Derris H. Banks
*Assistant Examiner*—Debra M Wolfe
(74) *Attorney, Agent, or Firm*—Rabin & Berdo, P.C.

(57) ABSTRACT

To easily adjust and change a locus of a leading end (an endless locus) of a cutter, a wire rod cutting apparatus of spring manufacturing machine has structure so that a slide may vertically slide via a connection rod by rotating a rotation shaft, and a cutter mounting oscillating arm can oscillate laterally via a sliding element by oscillating the connection rod, so that the locus thereof in the oscillating arm can be set to a predetermined shape which is endless in a front view and different between an outward and a homeward routes, by sliding the slide and oscillating the oscillating arm by actuation of the actuating apparatus and that a lateral oscillating amount of the oscillating arm can be changed by changing the position of the sliding element, to change the locus of the cutter leading end.

6 Claims, 15 Drawing Sheets

WIRE ROD CUTTING APPARATUS OF SPRING MANUFACTURING MACHINE

CROSS-REFERENCE TO RELATED APPLICATIONS

This is a continuation-in-part of U.S. patent application Ser. No. 10/847,284, filed on May 18, 2004 now U.S. Pat. No. 7,055,356.

BACKGROUND OF THE INVENTION

1. Field of the Invention

The present invention relates to a wire rod cutting apparatus of a spring manufacturing machine.

2. Description of Related Art

In conventional, the following structure has been known as this kind of wire rod cutting apparatus.

There has been known a wire rod cutting apparatus of a spring manufacturing machine for manufacturing a spring by discharging a wire rod to a wire rod processing space provided in front of a front wall of a machine casing from a final wire rod guide provided in the front wall, and applying a predetermined process to the wire rod which is discharged to the wire rod processing space or is going to be discharged to the wire rod processing space, by a tool which protrudes or is protruding to the wire rod processing space, wherein the wire rod cutting apparatus comprises a slide which is slidably provided in the front wall in such a manner as to slide in the direction (vertical direction) orthogonal to a center line of a wire rod guide, a cutter mounting oscillating arm which is provided in the slide so as to freely oscillate by a pivot shaft having an axis directed to the longitudinal direction, and further comprises an actuating apparatus which slides the slide and oscillates the cutter mounting oscillating arm, or further comprises a slide driving apparatus which slides the slide and an arm driving apparatus which oscillates the cutter mounting oscillating arm (refer to Japanese Patent Publication No. 8-15635 and Japanese Patent Publication No. 7-115101).

Such conventional wire rod cutting apparatus slides the slide and oscillates the cutter mounting oscillating arm by the actuating apparatus, or by cooperation of the slide driving apparatus and the arm driving apparatus, and thus can set a locus of a leading end of a cutter mounted to the cutter mounting oscillating arm to a predetermined shape which is different between an outward route and a homeward route and is a line symmetrical and bulgy endless in a front view (as seen from a state of normally facing to the front wall).

The conventional wire rod cutting apparatus mentioned above has the following problems.

In order to cut the wire rod without "burrs" being generated, in the cutting process of the wire rod for forming the spring, it is necessary to adjust and change the locus (to adjust a shape and shift a position of the locus) of the leading end of the cutter (the endless locus) while taking into consideration a raw material of the wire rod, a diameter of the wire rod and the like. However, there is a problem that the conventional wire rod cutting apparatus can not easily adjust and shift the locus of the leading end of the cutter.

Also, the conventional wire rod cutting apparatus having the slide driving apparatus and the arm driving apparatus has a problem that failure easily occurs because its structure is complicate.

BRIEF SUMMARY OF THE INVENTION

In order to solve the problems of the conventional wire rod cutting apparatus mentioned above, the present invention employs the following means.

In accordance with a first aspect of the present invention wire rod cutting apparatus, there is provided a wire rod cutting apparatus of a spring manufacturing machine for manufacturing a spring by discharging a wire rod to a wire rod processing space provided in front of a front wall of a machine casing from a final wire rod guide provided in the front wall, and applying a predetermined process to the wire rod which is discharged to the wire rod processing space or is being discharged to the wire rod processing space, by a tool which protrudes or is protruding to the wire rod processing space, comprising: a slide which is slidably provided in the front wall so as to slide in the direction orthogonal to a center line of a wire rod passage of the final wire rod guide; a cutter mounting oscillating arm which is provided in the slide so as to freely oscillate by a pivot shaft having an axis directed in the longitudinal direction; and an actuating apparatus which slides the slide and oscillates the cutter mounting oscillating arm; wherein the actuating apparatus has: a rotation shaft which is in parallel to the pivot shaft; an eccentric pin which is directly or indirectly provided in the rotation shaft, is eccentric from the center of the rotation shaft and is in parallel to the rotation shaft; a connection rod which is pivotally attached to the eccentric pin in one end; and a connection pin which is provided in the slide in parallel to the eccentric pin and is pivotally attached to the other end of the connection rod; and the wire rod cutting apparatus comprises: a sliding element provided at either one of the connection rod and a portion, opposing to the connection rod, of the cutter mounting oscillating arm; a guide groove, provided on the other of the connection rod and the portion of the cutter mounting oscillating arm, and formed so that the sliding element is fitted therein with no play in the width direction, and one end in the length direction thereof is directed to the eccentric pin and the other end thereof is directed to the pivot shaft; and means for allowing the sliding element to change a position so as to change a distance from the pivot shaft by sliding the sliding element along the guide groove, and for fixing the sliding element at an optional position.

In accordance with a second aspect of the present invention, there is provided a wire rod cutting apparatus of a spring manufacturing machine for manufacturing a spring by discharging a wire rod to a wire rod processing space provided in front of a front wall of a machine casing from a final wire rod guide provided in the front wall, and applying a predetermined process to the wire rod which is discharged to the wire rod processing space or is being discharged to the wire rod processing space, by a tool which protrudes or is protruding to the wire rod processing space, comprising: a slide which is slidably provided in the front wall so as to slide in the direction orthogonal to a center line of a wire rod passage of the final wire rod guide; a cutter mounting oscillating arm which is provided in the slide so as to freely oscillate by a pivot shaft having an axis directed in the longitudinal direction; and an actuating apparatus which slides the slide and oscillates the cutter mounting oscillating arm; wherein the actuating apparatus has: a rotation shaft which is in parallel to the pivot shaft; an eccentric pin which is directly or indirectly provided in the rotation shaft, is eccentric from the center of the rotation shaft and is in parallel to the rotation shaft; a connection rod which is pivotally attached to the eccentric pin in one end; and a connection pin which is provided in the slide in parallel to the eccentric pin and is pivotally attached to the other end of the connection rod; and the wire rod cutting apparatus comprises: a protrusion provided at either one of the connection rod and a portion, opposing to the connection rod, of the cutter mounting oscillating arm; a guide member, provided on the other of the connection rod and the portion of the cutter mounting oscillating arm, and forming a guide groove in which the protrusion is fitted with no play in the lateral direction; and means for allowing the protrusion to change a position in the lateral direction with respect to either one, on which the protrusion is provided, of the connection rod and the cutter mounting oscillating arm, and for fixing the protrusion at an optional position.

Also, in accordance with a second aspect of the present invention, there is further provided a wire rod cutting apparatus of a spring manufacturing machine in which at least one of the protrusion and the guide member is detachable from a member to which the protrusion or the guide member is attached, and an oscillation preventing member for preventing oscillation of the cutter mounting oscillating arm is detachably provided in the slide.

Further, in accordance with a third aspect of the present invention, there is provided a wire rod cutting apparatus of a spring manufacturing machine for manufacturing a spring by discharging a wire rod to a wire rod processing space provided in front of a front wall of a machine casing from a final wire rod guide provided in the front wall, and applying a predetermined process to the wire rod which is discharged to the wire rod processing space or is being discharged to the wire rod processing space, by a tool which protrudes or is protruding to the wire rod processing space, comprising: a slide which is slidably provided in the front wall so as to slide in the direction orthogonal to a center line of a wire rod passage of the final wire rod guide; a cutter mounting oscillating arm which is provided in the slide so as to freely oscillate by a pivot shaft having an axis directed in the longitudinal direction; and an actuating apparatus which slides the slide and oscillates the cutter mounting oscillating arm; wherein the actuating apparatus has: a rotation shaft which is in parallel to the pivot shaft; an eccentric pin which is directly or indirectly provided in the rotation shaft, is eccentric from the center of the rotation shaft and is in parallel to the rotation shaft; a connection rod which is pivotally attached to the eccentric pin in one end; and a connection pin which is provided in the slide in parallel to the eccentric pin and is pivotally attached to the other end of the connection rod; and the wire rod cutting apparatus comprises: a sliding element provided at either one of the connection rod and a portion, opposing to the connection rod, of the cutter mounting oscillating arm; a block member, provided on the other of the connection rod and the portion of the cutter mounting oscillating arm, in which a guide passage is formed, the sliding element being fitted in the guide passage with no play in the width direction, and one end in the length direction of the guide passage being directed to the eccentric pin and the other end of the same being directed to the pivot shaft; means for allowing the sliding element to change a position so as to change a distance from the pivot shaft by moving the sliding element along the guide passage, and for fixing the sliding element at an optional position within a range of a length of the guide passage; and means for allowing the block member to laterally change a position with respect to either one, on which the block member is provided, of the connection rod and the cutter mounting oscillating arm, and for fixing the block member at an optional position.

Also, in accordance with a fourth aspect of the present invention, there is provided a wire rod cutting apparatus of a spring manufacturing machine for manufacturing a spring by discharging a wire rod to a wire rod processing space provided in front of a front wall of a machine casing from a final wire rod guide provided in the front wall, and applying a predetermined process to the wire rod which is discharged to the wire rod processing space or is being discharged to the wire rod processing space, by a tool which protrudes or is protruding to the wire rod processing space, comprising: a slide which is slidably provided in the front wall so as to slide in the direction orthogonal to a center line of a wire rod passage of the final wire rod guide; a cutter mounting oscillating arm which is provided in the slide so as to freely oscillate by a pivot shaft having an axis directed in the longitudinal direction; and an actuating apparatus which slides the slide and oscillates the cutter mounting oscillating arm; wherein the actuating apparatus has: a rotation shaft which is in parallel to the pivot shaft; an eccentric pin which is directly or indirectly provided in the rotation shaft, is eccentric from the center of the rotation shaft and is in parallel to the rotation shaft; a connection rod which is pivotally attached to the eccentric pin in one end; and a connection pin which is provided in the slide in parallel to the eccentric pin and is pivotally attached to the other end of the connection rod; and the wire rod cutting apparatus comprises: a sliding element provided at either one of the connection rod and a portion, opposing to the connection rod, of the cutter mounting oscillating arm; a block member, provided on the other of the connection rod and the portion of the cutter mounting oscillating arm, in which a guide passage is formed, the sliding element being fitted in the guide passage with no play in the width direction, and one end in the length direction of the guide passage being directed to the eccentric pin and the other end of the same being directed to the pivot shaft; means for allowing the sliding element to change a position so as to change a distance from the pivot shaft by moving the sliding element along the guide passage, and for fixing the sliding element at an optional position within a range of a length of the guide passage; a supporting shaft having an axis directed to the longitudinal direction, and attached to either one, on which the block member is provided, of the connection rod and the cutter mounting oscillating arm; and means for allowing the block member to laterally oscillate with respect to either one, on which the block member is provided, of the connection rod and the cutter mounting oscillating arm by supporting one end of the block member by the supporting shaft, and for fixing the oscillation of the block member centering around the supporting shaft at an optional position.

Also, in accordance with a fifth aspect of the present invention, there is provided a wire rod cutting apparatus of a spring manufacturing machine for manufacturing a spring by discharging a wire rod to a wire rod processing space provided in front of a front wall of a machine casing from a final wire rod guide provided in the front wall, and applying a predetermined process to the wire rod which is discharged to the wire rod processing space or is being discharged to the wire rod processing space, by a tool which protrudes or is protruding to the wire rod processing space, comprising: a slide which is slidably provided in the front wall so as to slide in the direction orthogonal to a center line of a wire rod passage of the final wire rod guide; a cutter mounting oscillating arm which is provided in the slide so as to freely oscillate by a pivot shaft having an axis directed in the longitudinal direction; and an actuating apparatus which slides the slide and oscillates the cutter mounting oscillating arm; wherein the actuating apparatus has: a rotation shaft which is in parallel to the pivot shaft; an eccentric pin which is directly or indirectly provided in the rotation shaft, is eccentric from the center of the rotation shaft and is in parallel to the rotation shaft; a connection rod which is pivotally attached to the eccentric pin in one end; and a connection pin which is provided in the slide in parallel to the eccentric pin and is pivotally attached to the other end of the connection rod; and the wire rod cutting apparatus comprises: a sliding element provided at either one of the connection rod and a portion, opposing to the connection rod, of the cutter mounting oscillating arm; a block member, provided on the other of the connection rod and the portion of the cutter mounting oscillating arm, in which a guide passage is formed, the sliding element being fitted in the guide passage with no play in the width direction, and one end in the length direction of the guide passage being directed to the eccentric pin and the other end of the same being directed to the pivot shaft; means for allowing the sliding element to change a position so as to change a distance from the pivot shaft by sliding the sliding element along the guide passage, for allowing the sliding element to laterally change a position with respect to either one, on which the block member is provided, of the connection rod and the cutter mounting oscillating arm, and for fixing the sliding element at an optional position.

Each aspect of the present invention of a wire rod cutting apparatus can achieve the following effect by adopting the structure mentioned above.

In accordance with the first aspect of the present invention of a wire rod cutting apparatus, it is possible to easily adjust a shape of the locus of the leading end of the cutter (the endless locus) by changing the position of the sliding element.

In accordance with the second aspect of the present invention of a wire rod cutting apparatus, it is possible to slide the slide and oscillate the cutter mounting oscillating arm by the actuating apparatus having simple construction, and to easily shift the locus of the leading end of the cutter in the lateral direction so as to preferably cut a raw material of the wire rod.

Also, in accordance with the second aspect of the present invention of a wire rod cutting apparatus, it is possible to easily make a shape of the locus of the leading end of the cutter be straight.

In accordance with the third through fifth aspects of the present invention of a wire rod cutting apparatus, it is possible to adjust a shape and shift a position of the locus of the leading end of the cutter by changing the position of the sliding element from the pivot shaft.

Further, in accordance with the third through fifth aspects of the present invention of a wire rod cutting apparatus, it is possible to easily shift the locus of the leading end of the cutter in the lateral direction so as to preferably cut a raw material of the wire rod, by adjusting position of the block member in the lateral direction, by adjusting position of a free end of the block member in the lateral direction, and by adjusting position of the sliding element in the lateral direction.

The above and further objects and features of the invention will more fully be apparent from the following detailed description with accompanying drawings.

DETAILED DESCRIPTION OF THE PRESENT INVENTION

Figure 1:
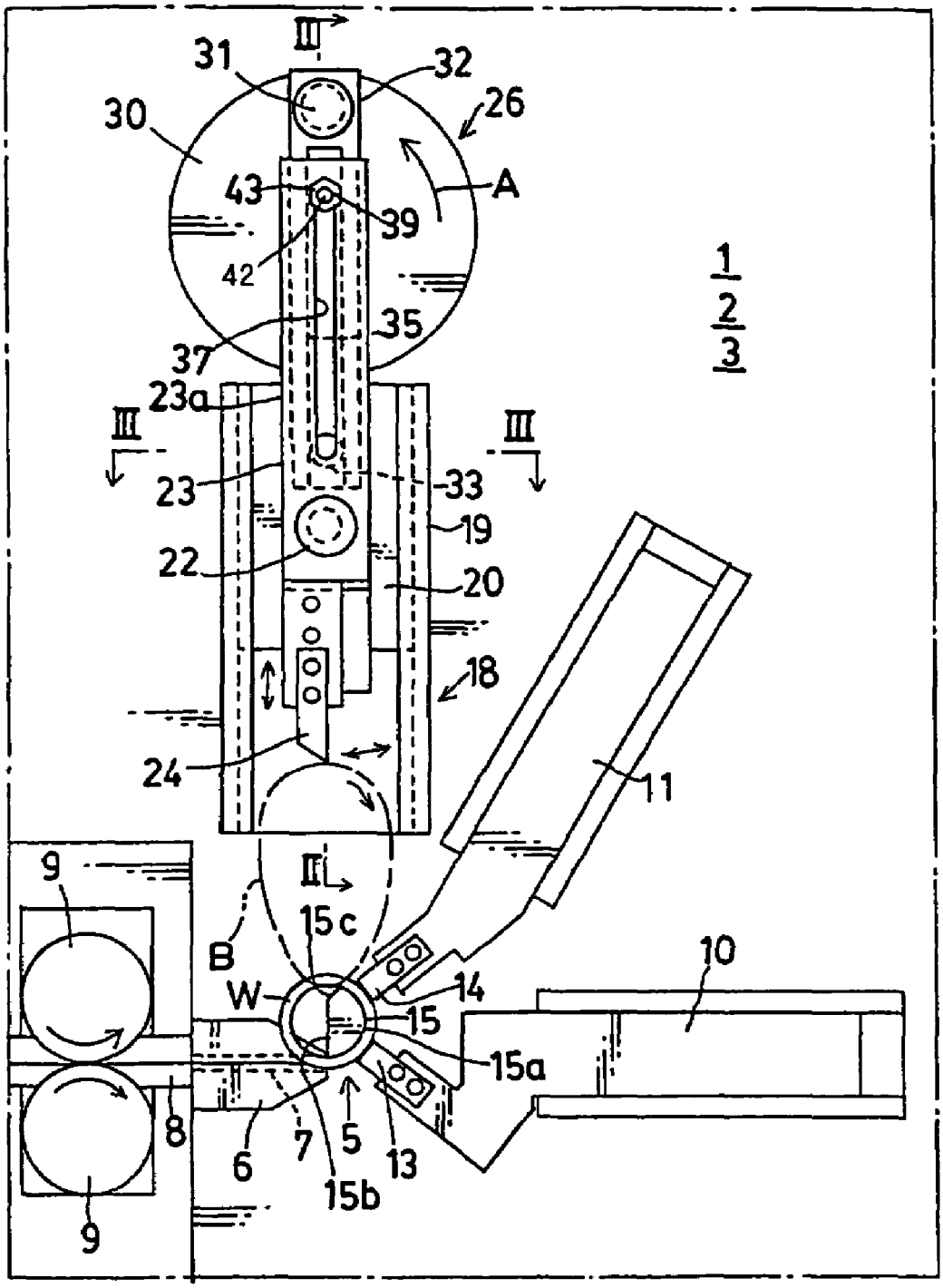
FIG. 1 is a front view of a main portion showing a first embodiment of a wire rod cutting apparatus in accordance with the present invention.

A description will be given below of embodiments in accordance with the present invention referring to the drawings.

First Embodiment

A detailed description will be given below of a first embodiment of a wire rod cutting apparatus in accordance with the present invention referring to the drawings.

Figure 2:
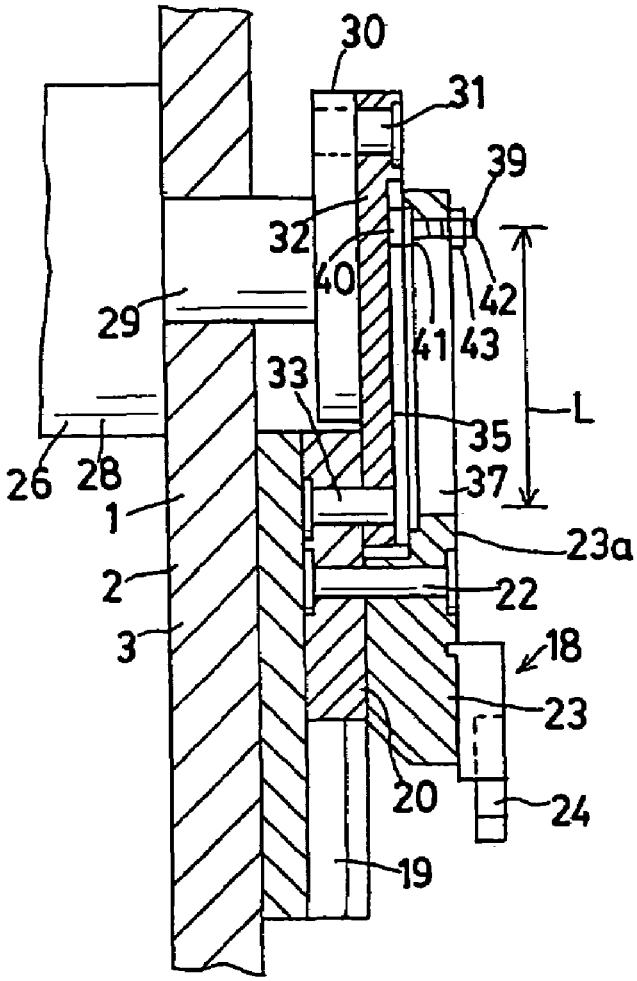
FIG. 2 is a cross sectional view along a line II-II in FIG. 1.
Figure 3:
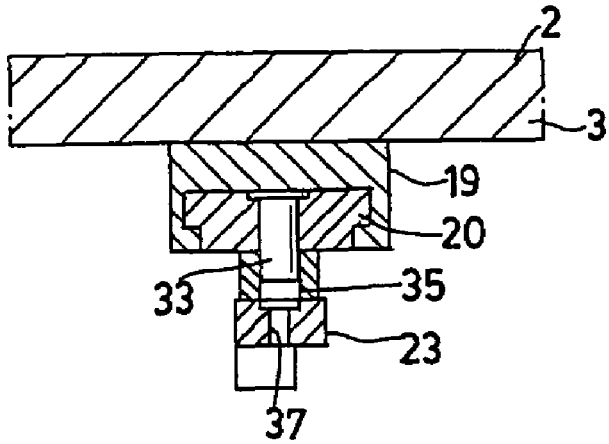
FIG. 3 is a cross sectional view along a line III-III in FIG. 1.

FIG. 1 is a front view of a main portion showing the first embodiment of a wire rod cutting apparatus in accordance with the present invention, FIG. 2 is a cross sectional view along a line II-II in FIG. 1, and FIG. 3 is a cross sectional view along a line III-III in FIG. 1.

In addition, in the following description of the first embodiment, front means the top side of a paper surface in FIG. 1, rear means the back side of the same, left means the left side in FIG. 1 and right means the right side in FIG. 1.

A spring manufacturing machine 1 has a machine casing 2 which has a vertical front wall 3, a wire rod processing space 5 which is formed in front of the front wall 3 in the machine casing 2, a final wire rod guide 6 which has a wire rod passage 7 passing a wire rod W discharged toward the wire rod processing space 5 therethrough and is provided in the front wall 3, at least one pair of wire rod feeding rollers 9 which are rotatably provided in the front wall in the opposite side to the wire rod processing space 5 in the final wire rod guide 6, and discharge the wire rod W while pinching the wire rod W, a first bending die slide 10 which is opposed to the final wire rod guide 6 beyond the wire rod processing space 5 and is provided in the front wall 3 so as to move close to and apart from the wire rod processing space 5, and a second bending die slide 11 which is opposed to the final wire rod guide 6 beyond the wire rod processing space 5 and is provided in the front wall 3 so as to freely move close to and apart from the wire rod processing space 5. In this case, positions of the first bending die slide 10 and the second bending die slide 11 are adjusted by a known actuating apparatus (not shown).

An auxiliary wire rod guide 8 is provided in the front wall 3 between the final wire rod guide 6 and the wire rod feeding roller 9.

A first bending die 13 is mounted to an end portion of the first bending die slide 10 in the side of the wire rod processing space 5, and a second bending die 14 is mounted to an end portion of the second bending die slide 11 in the side of the wire rod processing space 5.

A core bar 15 is provided in the front wall 3 so as to protrude to the front side and to be positioned in the wire rod processing space 5. In a front view, the core bar 15 has an arc surface 15*a* which is protruded toward the first bending die 13 and the second bending die 14, a vertical surface 15*b* in the side of the final wire rod guide 6, and a slope surface 15*c* which connects the upper end of the vertical surface 15*b* to the upper end of the arc surface 15*a* and is inclined downward toward the final wire rod guide 6.

As is well known, the wire rod W discharged from the final wire rod guide 6 is bent by the first bending die 13 and the second bending die 14.

A wire rod cutting apparatus 18 is provided in the front wall 3 so as to be positioned above the wire rod processing space 5.

The wire rod cutting apparatus 18 has a slide 20 which is guided by a guide member 19 provided in the front wall 3 and is slidable in the direction (vertical direction) orthogonal to a centerline of the wire rod passage 7 of the final wire rod guide 6, a cutter mounting oscillating arm 23 which is oscillatably provided in the slide 20 by a pivot shaft 22 having an axis directed to the longitudinal direction, and an actuating apparatus 26 which slides the slide 20 and oscillates the cutter mounting oscillating arm 23.

A cutter 24 is mounted to the end of the cutter mounting oscillating arm 23 in the side of the wire rod processing space 5.

The actuating apparatus 26 has a motor 28 which is mounted to the rear surface of the front wall 3 so as to direct an axis of a reversibly rotating rotation shaft 29 in the longitudinal direction, that is, in parallel to the pivot shaft 22. As shown in FIG. 2, the rotation shaft 29 protrudes to the front side of the front wall 3 through the front wall 3, a disc 30 is mounted to the front end of the rotation shaft 29, and an eccentric pin 31 is provided in the disc 30 in parallel to the rotation shaft 29 so as to be positioned at a position eccentric from the center of the rotation shaft 29.

One end of a connection rod 32 is pivotally attached to the eccentric pin 31, and the other end of the connection rod 32 is pivotally attached to a connection pin 33 which is provided in the slide 20 in parallel to the eccentric pin 31. A guide groove 35 is formed in the connection rod 32 along the connection rod 32. One end of the guide groove 35 is directed to the eccentric pin 31, and the other end of the guide groove 35 is directed to the pivot shaft 22. In addition, a front surface of the eccentric pin 31 is formed so as to not protrude from a front surface of the connection rod 31. Also, a front surface of the connection pin 33 is formed so as to not protrude into the guide groove 35.

A slit 37 is formed in the longitudinal direction in an upper portion 23*a* of the cutter mounting oscillating arm 23 in the upper side than the pivot shaft 22 (in a portion of the cutter mounting oscillating arm 23 opposing to the connection rod 32). One end of the slit 37 is directed to the eccentric pin 31, and the other end of the slit 37 is directed to the pivot shaft 22. A sliding member 39 which is freely changeable in position by sliding along the slit 37 is provided. In this case, a moving distance of the sliding member 39 is denoted by reference symbol "L" in FIG. 2. The sliding member 39 has a sliding element 40 which is fitted in the guide groove 35 with no play in the width direction, a flange 41 to which the sliding element 40 is rotatably mounted, a screw 42 which is provided in the flange 41 so as to protrude to the front side through the slit 37, and a nut 43 which is screwed and fitted to the screw 42. The sliding member 39 (the sliding element 40) can be fixed at an optional position within the slit 37 in the state in which an edge portion of the slit 37 is clamped by the flange 41 and the nut 43, by adjusting the position of the sliding member 39 in the state in which the nut 43 is loosened, and thereafter fastening the nut 43.

In accordance with the structure mentioned above, the connection rod 32 vertically reciprocates and laterally oscillates simultaneously on the basis of the rotation of the rotation shaft 29 (the rotation in the direction of an arrow A in FIG. 1). As a result, since the connection rod 32 makes the connection pin 33 vertically reciprocate, it is possible to vertically slide the slide 20 in a state where it is guided by the guide member 19. Further, it is possible to laterally oscillate the cutter mounting oscillating arm 23 centering around the pivot shaft 22 via the sliding element 40 on the basis of the oscillation of the connection rod 32. In other words, it is possible to set the locus of the leading end of the cutter 24 mounted to the cutter mounting oscillating arm 23 to a predetermined shape (refer to an alternate long and short dash line B in FIG. 1) which is different between an outward route and a homeward route and is a line symmetrical and bulgy endless in a front view (as seen from a state of normally facing to the front wall 3) with respect to a line in parallel with the moving direction of the slide 20 (in other words, a line orthogonal to the centerline of the wire rod passage 7 of the final wire rod guide 6), by sliding the slide 20 and oscillating the cutter mounting oscillating arm 23 on the basis of an actuation of the actuating apparatus 26. Further, it is possible to change a lateral oscillating amount of the cutter mounting oscillating arm 23 by changing the fixed position of the sliding element 40, in other words, by changing the distance from the eccentric pin 31, whereby it is possible to adjust the shape (bulging degree) of the locus of the leading end of the cutter 24. In this case, when the center of the sliding element 40 coincides with the center of the connection pin 33, the cutter mounting oscillating arm 23 is not absolutely oscillated.

Figure 4:
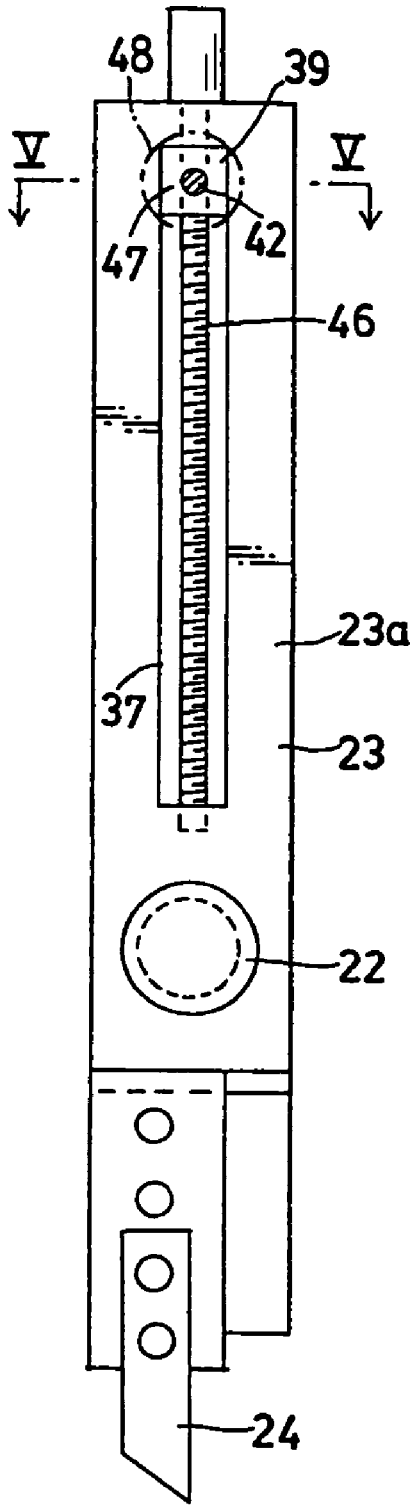
FIG. 4 is a front view showing a modified embodiment of a cutter mounting oscillating arm of the first embodiment.
Figure 5:
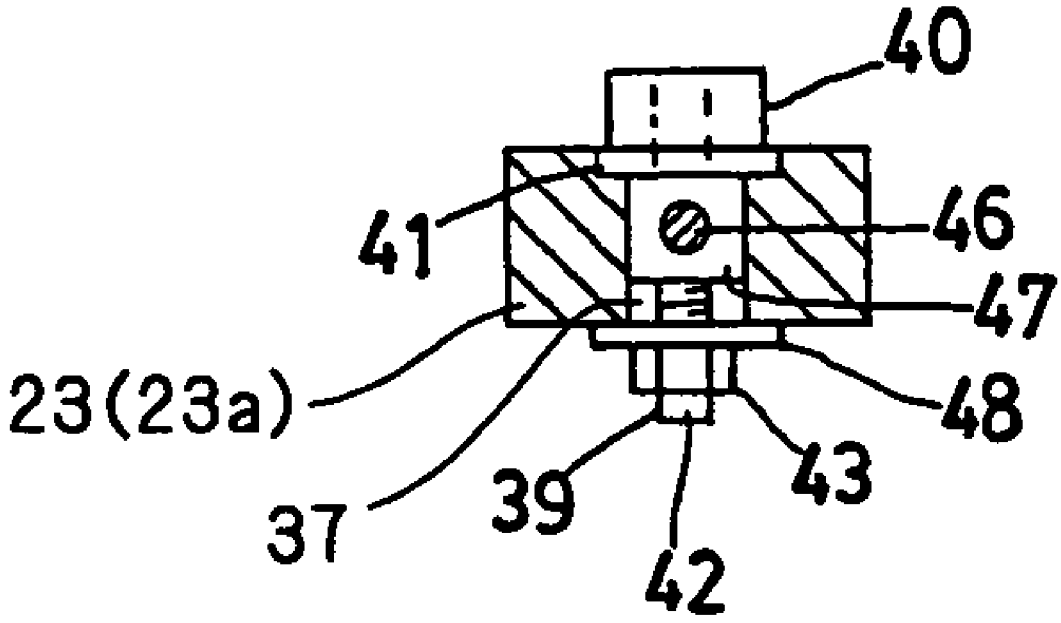
FIG. 5 is a cross sectional view along a line V-V in FIG. 4.

Next, a description will be given below of a modified embodiment of the cutter mounting oscillating arm 23 of the first embodiment. FIG. 4 is a front view showing a modified embodiment of a cutter mounting oscillating arm of the first embodiment, and FIG. 5 is a cross sectional view along a line V-V in FIG. 4. In this case, the same elements as the elements shown in FIG. 1 to FIG. 3 are denoted by the same reference numerals.

A screw rod 46 is rotatably provided in the slit 37 of the cutter mounting oscillating arm 23 so as to be in parallel to the slit 37, a female thread body 47 is screwed to the screw rod 46, and the flange 41 and the screw 42 are provided in the female thread body 47. In other words, the female thread body 47 is formed as one of constituting members of the sliding member 39. In this case, the female thread body 47 is fitted in the slit 37 with no play in the width direction. Further, a washer 48 is fitted to the screw 42, and the nut 43 is screwed to the screw 42 so as to be positioned in front of the washer 48. In accordance with the structure mentioned above, it is possible to change a position of the female thread body 47 (the sliding body 40) along the slit 37 by rotating the screw rod 46 in the state in which the nut 43 is loosened.

As some modified embodiments of the first embodiment as described above, following structures may be adopted.

The structure may be made such that the sliding element 40 is provided in the connection rod 32 so as to be changed in position along the length direction, and the guide groove 35 is provided in the upper portion 23*a* of the cutter mounting oscillating arm 23.

The guide groove 35 includes a slit.

The tools include bending die, forming tool, and the like.

Second Embodiment

A detailed description will be given below of a second embodiment of a wire rod cutting apparatus in accordance with the present invention referring to the drawings.

Figure 6:
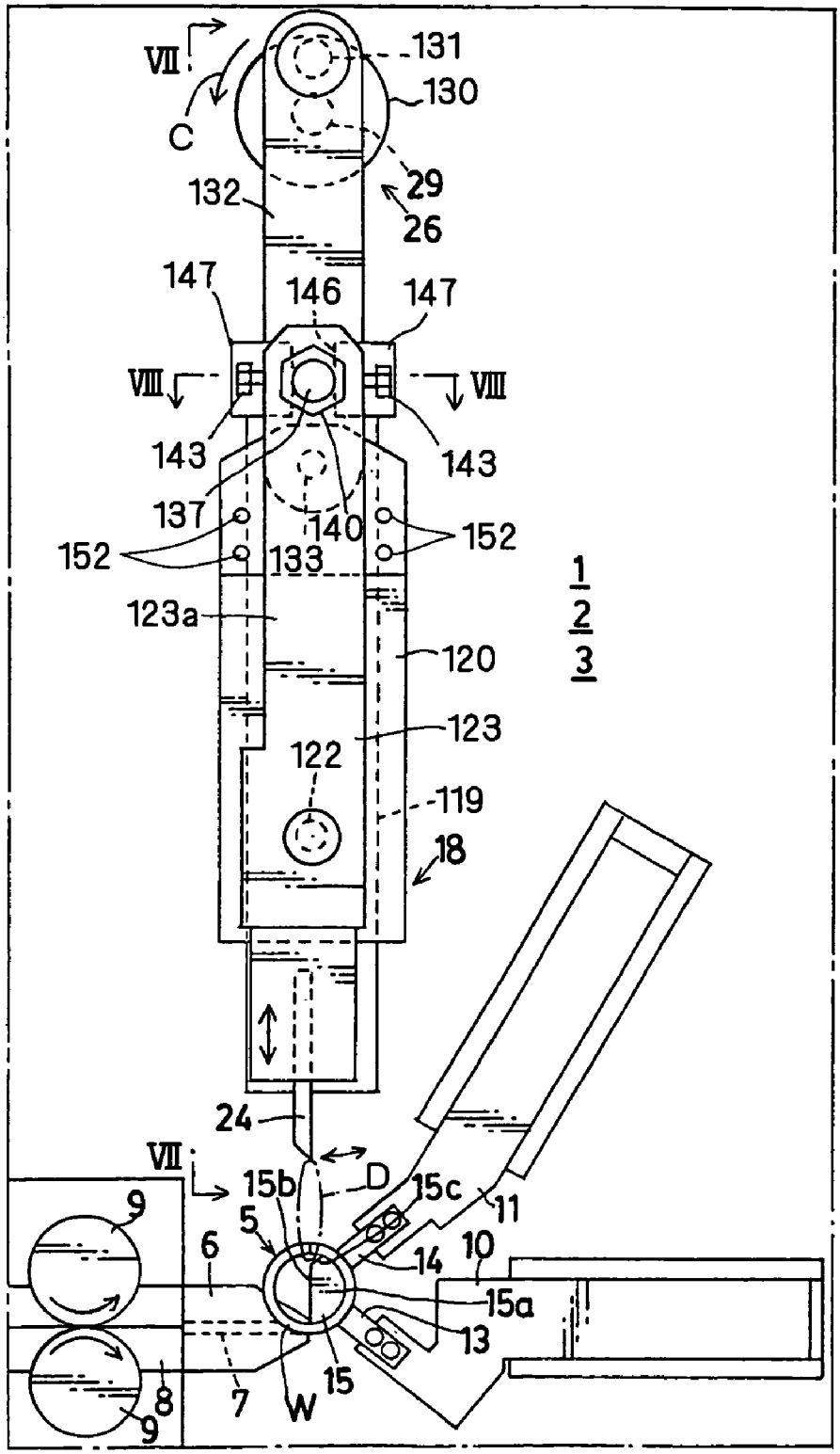
FIG. 6 is a front view of a main portion showing a second embodiment of a wire rod cutting apparatus in accordance with the present invention.
Figure 7:
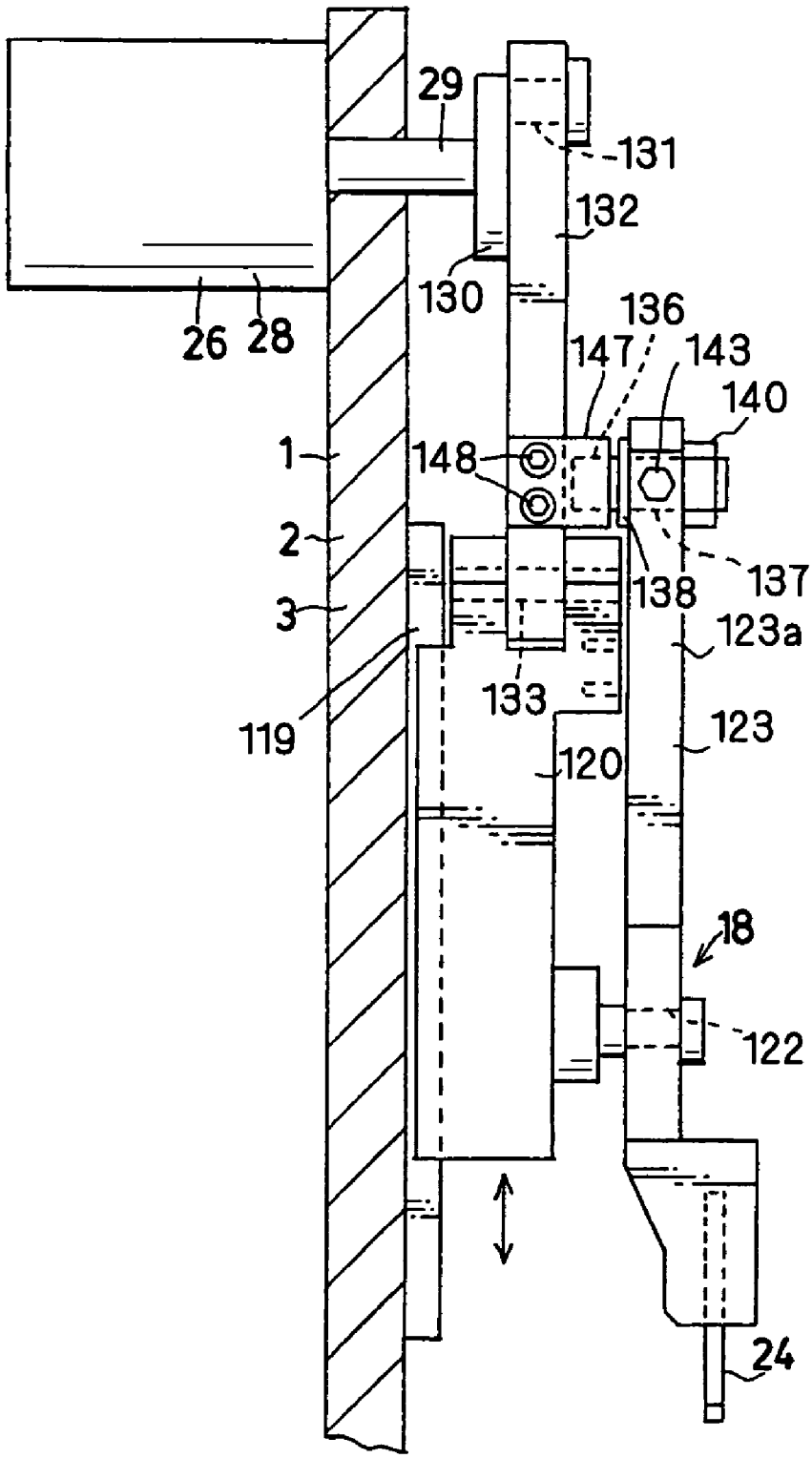
FIG. 7 is a cross sectional view along a line VII-VII in FIG. 6.
Figure 8:
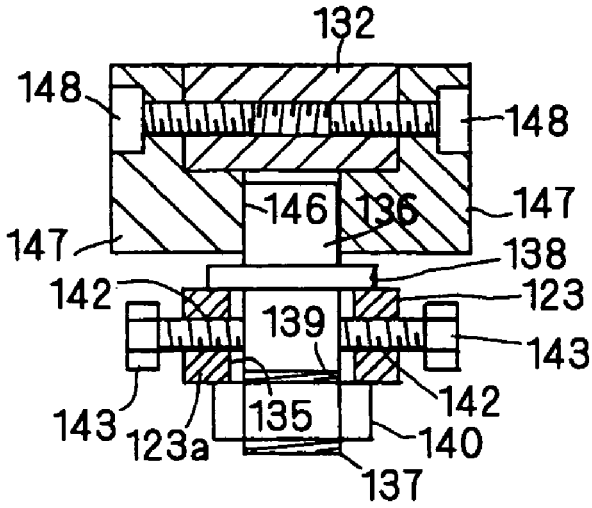
FIG. 8 is an enlarged cross sectional view along a line VIII-VIII in FIG. 6.

FIG. 6 is a front view of a main portion showing the second embodiment of a wire rod cutting apparatus in accordance with the present invention, FIG. 7 is a cross sectional view along a line VII-VII in FIG. 6, and FIG. 8 is an enlarged cross sectional view along a line VIII-VIII in FIG. 6. In addition, in the following description of the second embodiment, front means the top side of a paper surface in FIG. 6, rear means the back side thereof, left means the left side in FIG. 6 and right means the right side in FIG. 6.

A spring manufacturing machine 1 has a machine casing 2 which has a vertical front wall 3, a wire rod processing space 5 which is formed in front of the front wall 3 in the machine casing 2, a final wire rod guide 6 which has a wire rod passage 7 passing a wire rod W discharged toward the wire rod processing space 5 therethrough and is provided in the front wall 3, at least one pair of wire rod feeding rollers 9 which are rotatably provided in the front wall in the opposite side to the wire rod processing space 5 in the final wire rod guide 6, and discharge the wire rod W while pinching the wire rod W, a first bending die slide 10 which is opposed to the final wire rod guide 6 beyond the wire rod processing space 5 and is provided in the front wall 3 so as to move close to and apart from the wire rod processing space 5, and a second bending die slide 11 which is opposed to the final wire rod guide 6 beyond the wire rod processing space 5 and is provided in the front wall 3 so as to freely move close to and apart from the wire rod processing space 5. In this case, positions of the first bending die slide 10 and the second bending die slide 11 are adjusted by a known actuating apparatus (not shown).

An auxiliary wire rod guide 8 is provided in the front wall 3 between the final wire rod guide 6 and the wire rod feeding roller 9.

A first bending die 13 is mounted to an end portion of the first bending die slide 10 in the side of the wire rod processing space 5, and a second bending die 14 is mounted to an end portion of the second bending die slide 11 in the side of the wire rod processing space 5.

A core bar 15 is provided in the front wall 3 so as to protrude to the front side and to be positioned in the wire rod processing space 5. In a front view, the core bar 15 has an arc surface 15*a* which is protruded toward the first bending die 13 and the second bending die 14, a vertical surface 15*b* in the side of the final wire rod guide 6, and a slope surface 15*c* which connects the upper end of the vertical surface 15*b* to the upper end of the arc surface 15*a* and is inclined downward toward the final wire rod guide 6.

As is well known, the wire rod W discharged from the final wire rod guide 6 is bent by the first bending die 13 and the second bending die 14.

A wire rod cutting apparatus 18 is provided in the front wall 3 so as to be positioned above the wire rod processing space 5.

The wire rod cutting apparatus 18 has a slide 120 which is guided by a guide member 119 provided in the front wall 3 and is slidable in the direction (vertical direction) orthogonal to a centerline of the wire rod passage 7 of the final wire rod guide 6, a cutter mounting oscillating arm 123 which is oscillatably provided in the slide 120 by a pivot shaft 122 having an axis directed to the longitudinal direction, and an actuating apparatus 26 which slides the slide 120 and oscillates the cutter mounting oscillating arm 123.

Note that, at both sides of an upper side portion of the slide 120, plural bolt holes 152 are bored at appropriate positions (in an example shown in figure, each two bolt holes on both the right and left sides are arranged in the vertical direction).

A cutter 24 is mounted to the end of the cutter mounting oscillating arm 123 in the side of the wire rod processing space 5.

The actuating apparatus 26 has a motor 28 which is mounted to the rear surface of the front wall 3 so as to direct an axis of a reversibly rotating rotation shaft 29 in the longitudinal direction, that is, in parallel to the pivot shaft 122. As shown in FIG. 7, the rotation shaft 29 protrudes to the front side of the front wall 3 through the front wall 3, a disc 130 is mounted to the front end of the rotation shaft 29, and an eccentric pin 131 is provided in the disc 130 in parallel to the rotation shaft 29 so as to be positioned at a position eccentric from the center of the rotation shaft 29.

One end of a connection rod 132 is pivotally attached to the eccentric pin 131, and the other end of the connection rod 132 is pivotally attached to a connection pin 133 which is provided in the slide 120 in parallel to the eccentric pin 131.

As shown in FIG. 8, in an upper end portion of an upper portion 123*a* (a portion in the upper side than the pivot shaft 122) of the cutter mounting oscillating arm 123, a laterally wide hole 135 which is wide in the lateral direction and penetrates the cutter mounting oscillating arm 123 in the longitudinal direction is formed. Into the laterally wide hole 135, a mounting portion 137 is fitted from the back side. Note that at the back side of the mounting portion 137, a flange 138 is formed and a protrusion 136 is provided so as to protrude toward the further back side than the flange 138. Moreover, the mounting portion 137, which is allowed to change its position by moving in the lateral direction within the laterally wide hole 135, is fitted in the laterally wide hole 135 with no play in the vertical direction. Then an edge portion of the laterally wide hole 135 is clamped by the above described flange 138 provided at the mounting portion 137 and a nut 140 screwed and fitted to a male thread portion 139 formed in the front portion of the mounting portion 137, so that the mounting portion 137 is fixed in the upper portion 123*a* of the cutter mounting oscillating arm 123. Moreover, in the right and left side portions of the laterally wide hole 135, screw holes 142 each having an axis directed to the lateral direction and laterally penetrating the cutter mounting oscillating arm 123 are formed, respectively. Bolts 143 are screwed into the respective screw holes 142 so that the front ends of the bolts 143 come into contact with the mounting portion 137, respectively. This prevents the mounting portion 137 from changing its position unexpectedly in the lateral direction within the laterally wide hole 135.

In accordance with the structure mentioned above, by loosening the nut 140 and then turning the right and left bolts 143 respectively to adjust the position of their end portions, it is possible to change the position of the mounting portion 137 (protrusion 136) in the lateral direction within the laterally wide hole 135. After changing the position, by fastening the nut 140 again, the position of the mounting portion 137 (protrusion 136) in the lateral direction within the laterally wide hole 135 is fixed. Therefore, the mounting portion 137 side (protrusion 136 side) of the cutter mounting oscillating arm 123 is allowed to oscillate centering around the pivot shaft 122 with respect to the connection rod 132, and is allowed to be fixed at an optional position. In other words, it is possible to make the centerline of the cutter mounting oscillating arm 123 and the centerline of the connection rod 132 be not in parallel. In this case, a locus of the leading end of the cutter 24 mounted to the end of the cutter mounting oscillating arm 123 in the side of the wire rod processing space 5 shifts in parallel in the lateral direction.

By the way, the connection rod 132 is provided with a guide groove 146, which is formed by: a space between the front side surfaces of a pair of right and left guide members 147 detachably provided by means of bolts 148 or the like so as to oppose to each other with an appropriate distance therebetween; and a front surface of the connection rod 132 which becomes a back surface of the space. The above described protrusion 136 is fitted in the guide groove 146 with no play in the lateral direction.

In accordance with the structure mentioned above, the connection rod 132 vertically reciprocates while laterally oscillating on the basis of the rotation of the rotation shaft 29 (the rotation in the direction of an arrow C in FIG. 6). As a result, since the connection rod 132 makes the connection pin 133 vertically reciprocate, it is possible to vertically slide the slide 120 in a state where it is guided by the guide member 119. Further, it is possible to laterally oscillate the cutter mounting oscillating arm 123 centering around the pivot shaft 122 via the guiding member 147 and protrusion 136 on the basis of the oscillation of the connection rod 132. In other words, it is possible to set the locus of the leading end of the cutter 24 mounted to the cutter mounting oscillating arm 123 to a predetermined shape (refer to an alternate long and short dash line D in FIG. 6) which is different between an outward route and a homeward route and is a line symmetrical and bulgy endless in a front view (as seen from a state of normally facing to the front wall 3) with respect to a line in parallel with the moving direction of the slide 120 (in other words, a line orthogonal to the centerline of the wire rod passage 7 of the final wire rod guide 6), by sliding the slide 120 and oscillating the cutter mounting oscillating arm 123 on the basis of an actuation of the actuating apparatus 26.

Further, it is possible to shift the locus of the leading end of the cutter 24 in parallel in the lateral direction, by changing a position of the mounting portion 137 (protrusion 136) in the lateral direction within the laterally wide hole 135.

Figure 9:
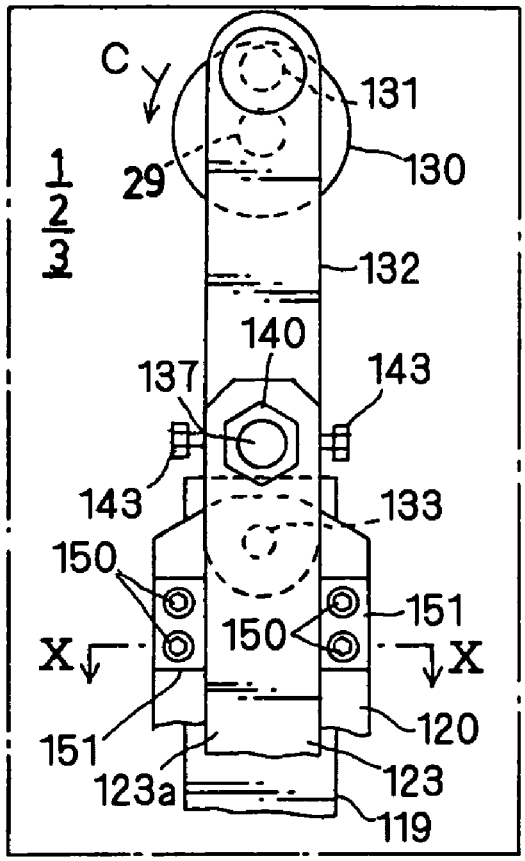
FIG. 9 is a front view of a main portion showing the second embodiment of a wire rod cutting apparatus in accordance with the present invention which is used under a state where the locus of the leading end of the cutter is made to be straight.
Figure 10:
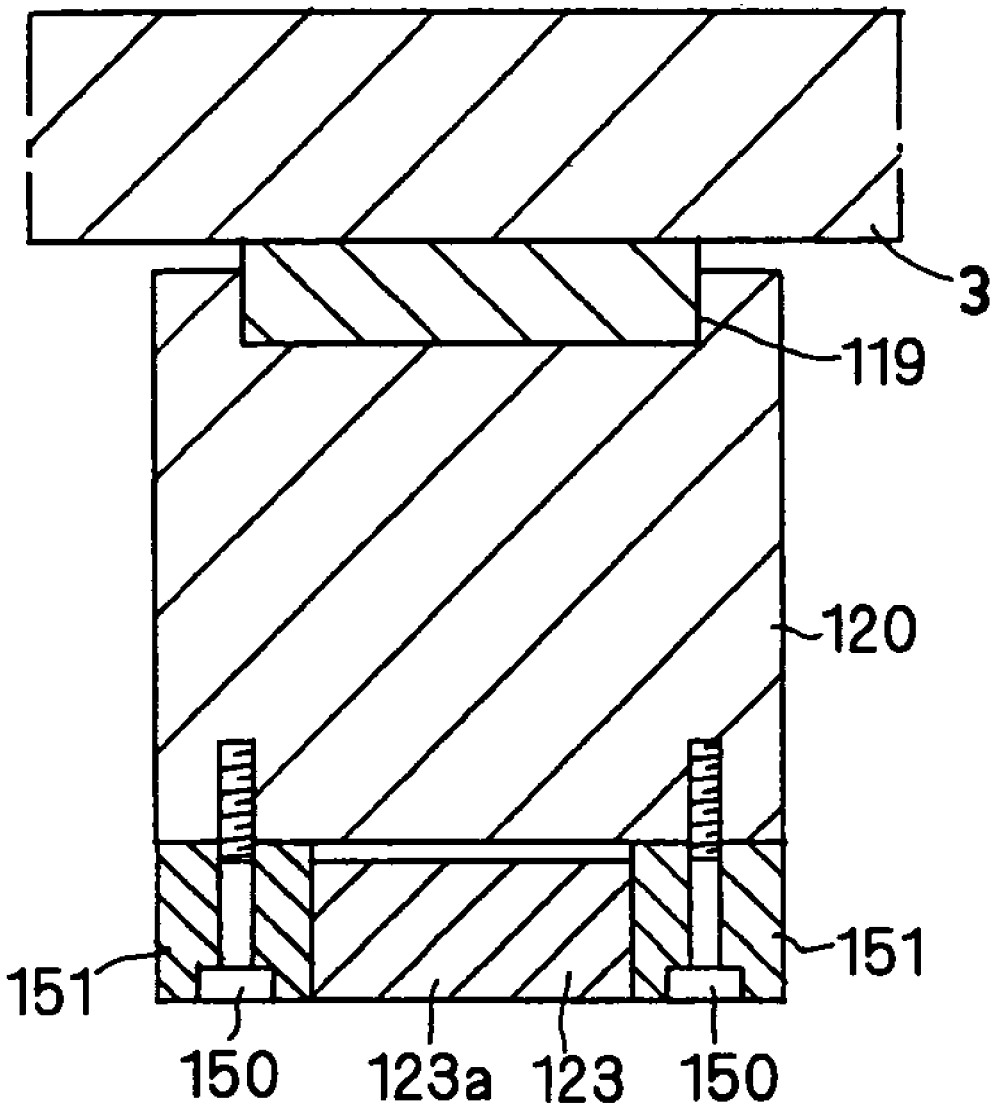
FIG. 10 is an enlarged cross sectional view along a line X-X in FIG. 9.

FIG. 9 and FIG. 10 show a state of the spring manufacturing machine 1 which is used under a state where the locus of the leading end of the cutter 24 is made to be straight. Note that FIG. 9 is a front view of a main portion showing a state in which the spring manufacturing machine 1 is used under a state where the locus of the leading end of the cutter is made to be straight, and FIG. 10 is an enlarged cross sectional view along a line X-X in FIG. 9. In FIG. 9 and FIG. 10, the same elements as the elements shown in FIG. 6 to FIG. 8 are denoted by the same reference numerals.

In FIG. 9 and FIG. 10, the guide member 147 is detached. This prevents the oscillation of the connection rod 132 from transmitted to the cutter mounting oscillating arm 123. Note that the same object can be achieved when the protrusion 136 is detached from the guide groove 146 of the guide member 147.

Then, an oscillation preventing member 151 for preventing oscillation of the cutter mounting oscillating arm 123 is mounted to the bolt holes 152, which is provided in the slide 120 as described above, with bolts 150.

In accordance with the structure mentioned above, since the oscillation of the cutter mounting oscillating arm 123 is prevented, the locus of the leading end of the cutter becomes straight. Note that, in this case, the core bar 15 is changed to the one that is suitable for the case where the locus of the leading end of the cutter 24 is straight, as a matter of course.

As some modified examples of the second Embodiment described above, the following structures may be adopted.

The protrusion 136 is provided in the connection rod 132, and the guide member 147 is provided in the upper portion 123*a* of the cutter mounting oscillating arm 123.

The guide groove 146 may be a slit.

The shape of the guide member 147 is optional, and the shape of the protrusion 136 is also optional.

The tools include bending die, forming tool, and the like.

Third Embodiment

A detailed description will be given below of a third embodiment of a wire rod cutting apparatus in accordance with the present invention referring to the drawings.

Figure 11:
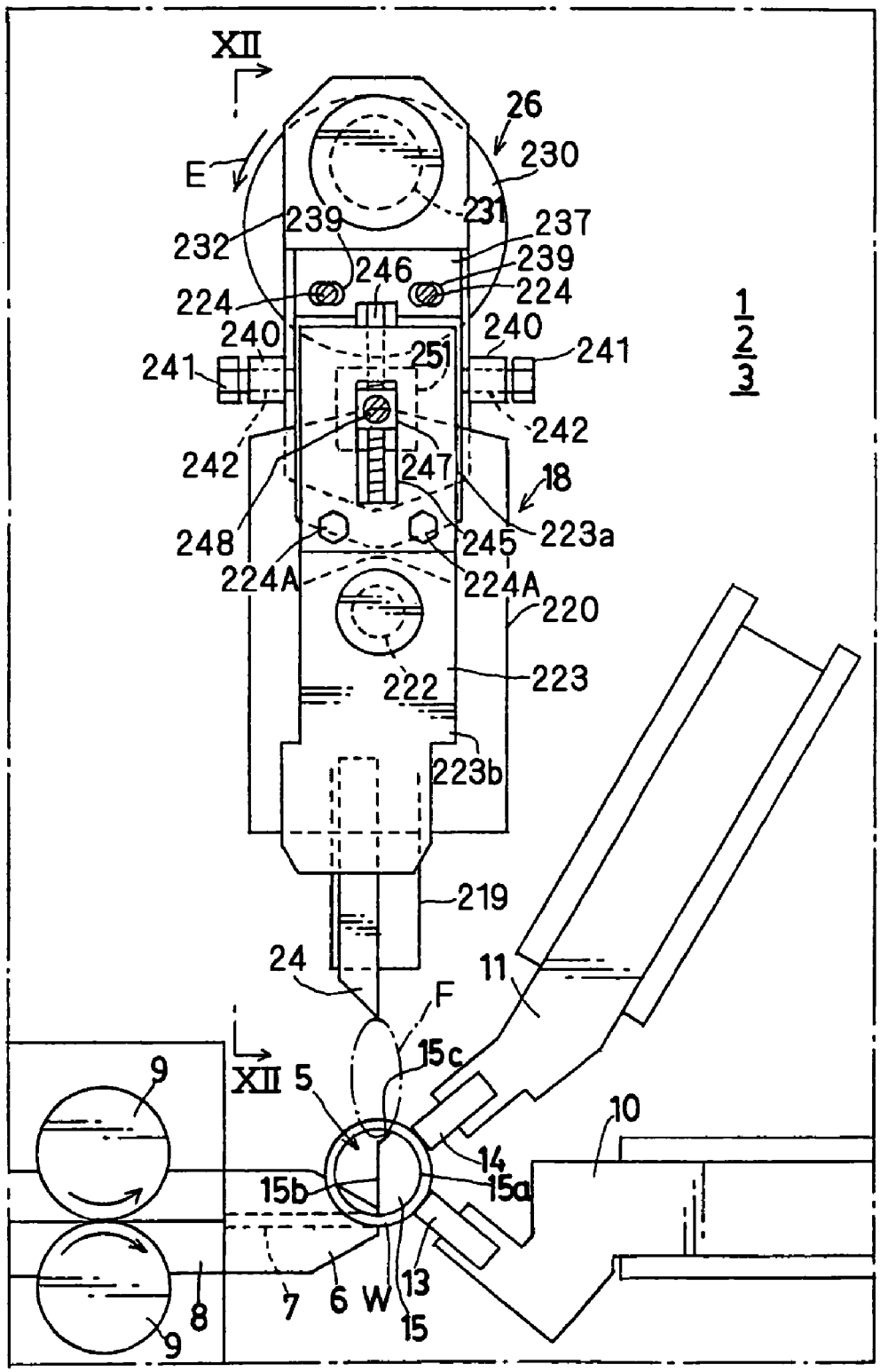
FIG. 11 is a front view of a main portion showing a third embodiment of a wire rod cutting apparatus in accordance with the present invention.
Figure 12:
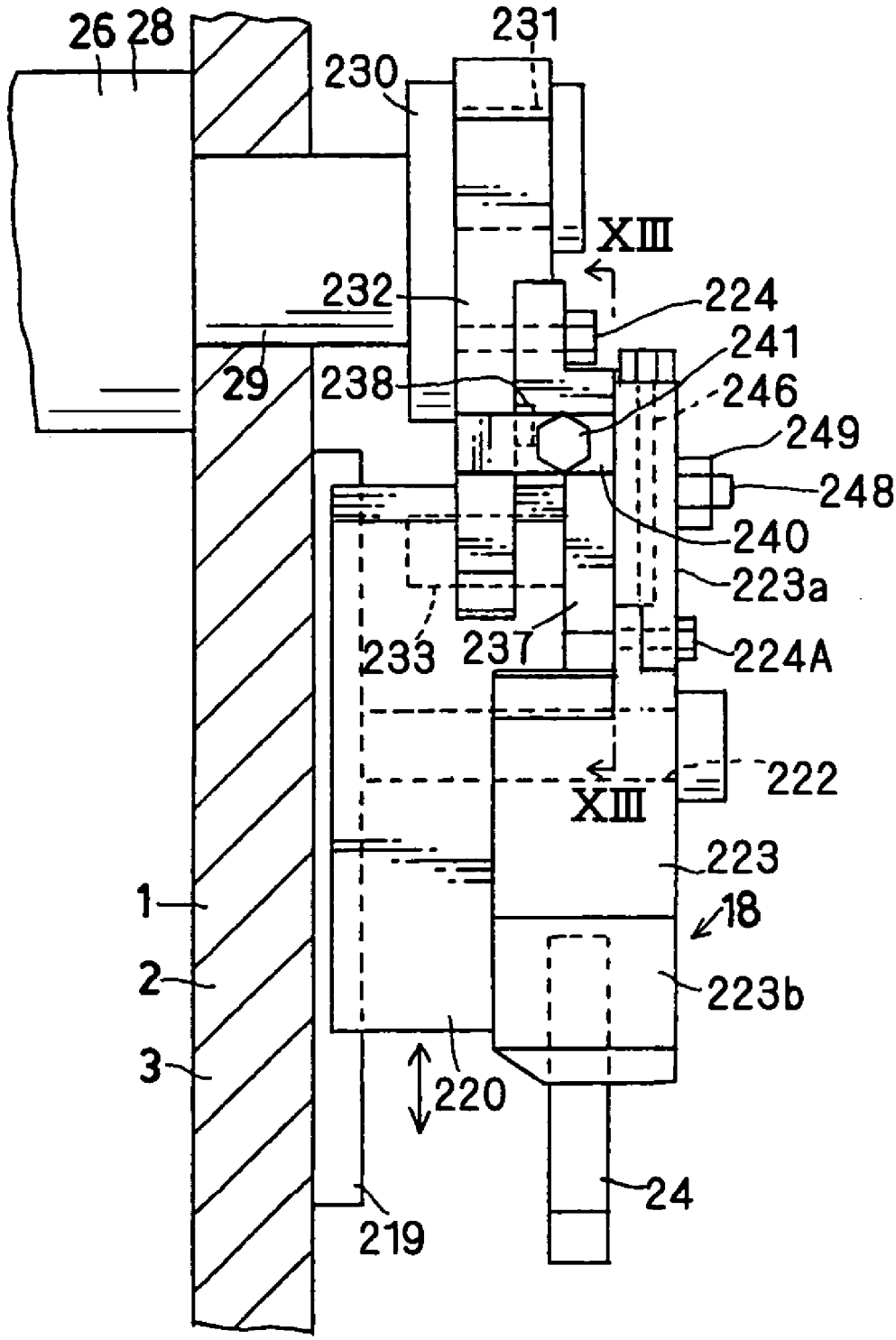
FIG. 12 is a cross sectional view along a line XII-XII in FIG.
Figure 13:
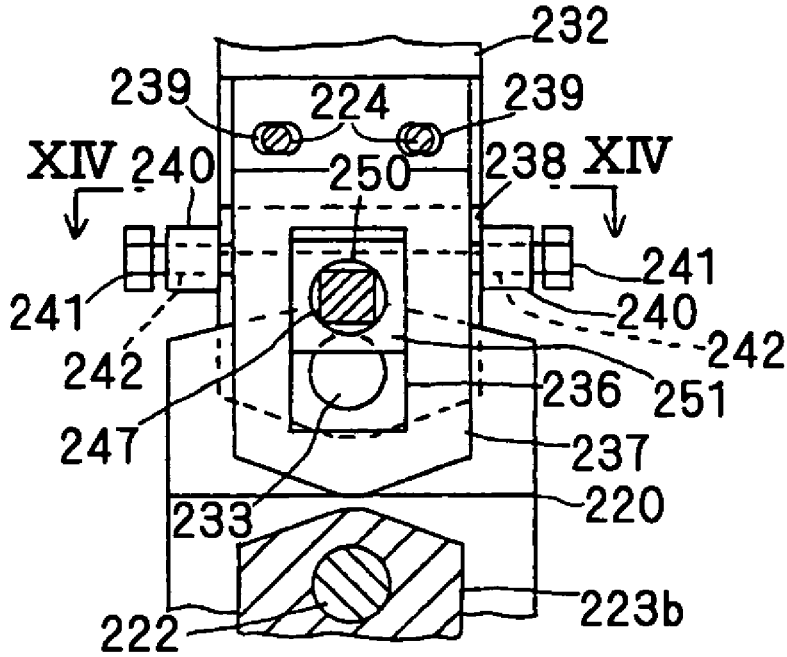
FIG. 13 is a cross sectional view along a line XIII-XIII in FIG. 12.
Figure 14:
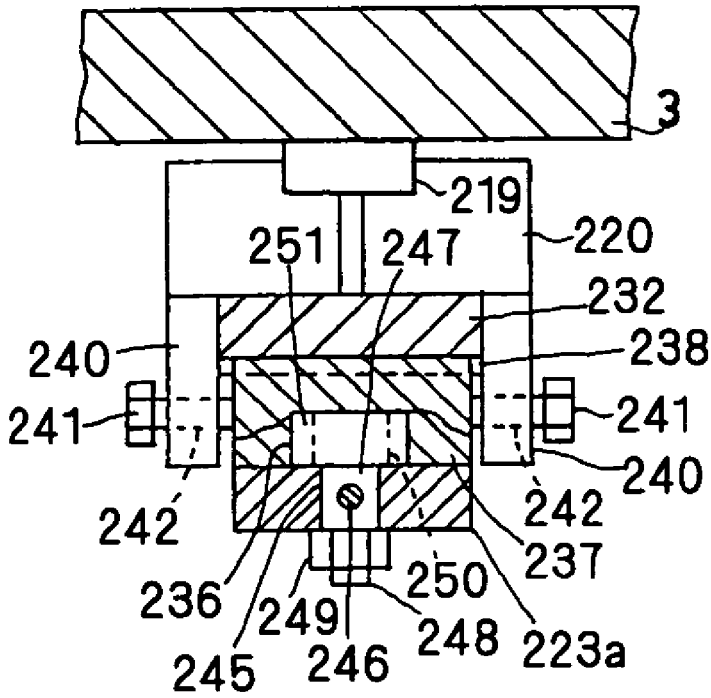
FIG. 14 is a cross sectional view along a line XIV-XIV in FIG. 13.

FIG. 11 is a front view of a main portion showing the third embodiment of a wire rod cutting apparatus in accordance with the present invention, FIG. 12 is a cross sectional view along a line XII-XII in FIG. 11, FIG. 13 is a cross sectional view along a line XIII-XIII in FIG. 12 and FIG. 14 is a cross sectional view along a line XIV-XIV in FIG. 13. In addition, in the following description of the third embodiment, front means the top side of a paper surface in FIG. 11, rear means the back side thereof, left means the left side in FIG. 11 and right means the right side in FIG. 11.

A spring manufacturing machine 1 has a machine casing 2 which has a vertical front wall 3, a wire rod processing space 5 which is formed in front of the front wall 3 in the machine casing 2, a final wire rod guide 6 which has a wire rod passage 7 passing a wire rod W discharged toward the wire rod processing space 5 therethrough and is provided in the front wall 3, at least one pair of wire rod feeding rollers 9 which are rotatably provided in the front wall in the opposite side to the wire rod processing space 5 in the final wire rod guide 6, and discharge the wire rod W while pinching the wire rod W, a first bending die slide 10 which is opposed to the final wire rod guide 6 beyond the wire rod processing space 5 and is provided in the front wall 3 so as to move close to and apart from the wire rod processing space 5, and a second bending die slide 11 which is opposed to the final wire rod guide 6 beyond the wire rod processing space 5 and is provided in the front wall 3 so as to freely move close to and apart from the wire rod processing space 5. In this case, positions of the first bending die slide 10 and the second bending die slide 11 are adjusted by a known actuating apparatus (not shown).

An auxiliary wire rod guide 8 is provided in the front wall 3 between the final wire rod guide 6 and the wire rod feeding roller 9.

A first bending die 13 is mounted to an end portion of the first bending die slide 10 in the side of the wire rod processing space 5, and a second bending die 14 is mounted to an end portion of the second bending die slide 11 in the side of the wire rod processing space 5.

A core bar 15 is provided in the front wall 3 so as to protrude to the front side and to be positioned in the wire rod processing space 5. In a front view, the core bar 15 has an arc surface 15*a* which is protruded toward the first bending die 13 and the second bending die 14, a vertical surface 15*b* in the side of the final wire rod guide 6, and a slope surface 15*c* which connects the upper end of the vertical surface 15*b* to the upper end of the arc surface 15*a* and is inclined downward toward the final wire rod guide 6.

As is well known, the wire rod W discharged from the final wire rod guide 6 is bent by the first bending die 13 and the second bending die 14.

A wire rod cutting apparatus 18 is provided in the front wall 3 so as to be positioned above the wire rod processing space 5.

The wire rod cutting apparatus 18 has a slide 220 which is slidable in the direction (vertical direction) orthogonal to a centerline of the wire rod passage 7 of the final wire rod guide 6, a cutter mounting oscillating arm 223 which is oscillatably provided in the slide 220 by a pivot shaft 222 having an axis directed to the longitudinal direction, and an actuating apparatus 26 which slides the slide 220 and oscillates the cutter mounting oscillating arm 223. In addition, the slide 220 is guided by a guide rail 219 which is provided in the front wall 3 and whose length direction is oriented in the vertical direction.

The cutter mounting oscillating arm 223 is divided into an upper portion 223*a* and a lower portion 223*b*. The upper portion 223*a* and the lower portion 223*b* are connected with each other by well known connecting means such as bolts 224A or the like. A cutter 24 is mounted to the end of the lower portion 223*b* in the side of the wire rod processing space 5.

The actuating apparatus 26 has a motor 28 which is mounted to the rear surface of the front wall 3 so as to direct an axis of a reversibly rotating rotation shaft 29 in the longitudinal direction, that is, in parallel to the pivot shaft 222. As shown in FIG. 12, the rotation shaft 29 protrudes to the front side of the front wall 3 through the front wall 3, a disc 230 is mounted to the front end of the rotation shaft 29, and an eccentric pin 231 is provided in the disc 230 in parallel to the rotation shaft 29 so as to be positioned at a position eccentric from the center of the rotation shaft 29.

One end of a connection rod 232 is pivotally attached to the eccentric pin 231, and the other end of the connection rod 232 is pivotally attached to a connection pin 233 which is provided in the slide 220 in parallel to the eccentric pin 231.

The connection rod 232 is provided with a block member 237 which can be moved in the lateral direction and can be fixed at an optional position by means as described below. In the block member 237, a guide passage 236 into which a sliding element 251 to be described later is fitted with no play in the width direction is formed. One end of the guide passage 236 is directed to the eccentric pin 231 and the other end of the guide passage 236 is directed to the pivot shaft 222. As shown in FIG. 13 and FIG. 14, the connection rod 232 is provided with a guide rail 238 whose length direction is oriented in the lateral direction. The block member 237 is allowed to slightly move laterally along the guide rail 238. The block member 237 is provided with two laterally wide holes 239 which are wide in the lateral direction so as to penetrate the block member 237 in the longitudinal direction. Through both of the laterally wide holes 239, bolts 224 are fitted in screw holes formed in the block member 237 respectively. Moreover, the connection rod is provided with a pair of right and left protruding pieces 240. The block member 237 is made to be positioned between the two protruding pieces 240. In both of the protruding pieces, screw holes 242 each having an axis opposing to the block member 237 and directed to the lateral direction are formed respectively. In both of the screw holes 242, bolts 241 are screwed and fitted respectively so that the front ends of the bolts 241 come into contact with the block member 237 respectively.

In accordance with the structure mentioned above, by adjusting the lateral position of the block member 237 with respect to the connection rod 232 in the state in which both of the bolts 241 are loosened, and thereafter fastening both of the bolts 241, it is possible to fix the lateral position of the block member 237 with respect to the connection rod 232. Therefore, the block member 237 side of the cutter mounting oscillating arm 223 is allowed to oscillate centering around the pivot shaft 222, and is allowed to be fixed at an optional position. In other words, it is possible to make the centerline of the cutter mounting oscillating arm 223 and the centerline of the connection rod 232 be not in parallel. In this case, a locus of the leading end of the cutter 24 mounted to the end of the cutter mounting oscillating arm 223 in the side of the wire rod processing space 5 shifts in parallel in the lateral direction.

In an upper portion 223*a* (a portion of the cutter mounting oscillating arm 223, opposing to the block member 237) of the cutter mounting oscillating arm 223, a slit 245 penetrating in the longitudinal direction is formed. One end of the slit 245 is directed to the eccentric pin 231 and the other end of the same is directed to the pivot shaft 222. In parallel to the slit 245, a screw 246 is provided in the upper portion 223*a* so as to freely rotate. Also, in the screw 246, a female thread body 247 is screwed and fitted. In the front portion of the female thread body 247, a screw 248 is provided, and to this screw 248, a nut 249 is screwed and fitted. In the rear portion of the female thread body 247, a pin 250 having an axis directed to the longitudinal direction is provided to protrude, and the sliding element 251 is fitted to the pin 250 so as to freely rotate. The sliding element 251 is fitted in the guide passage 236 with no play in the width direction and capable of moving along the guide passage 236.

In accordance with the structure mentioned above, it is possible to change a position of the female thread body 247 (sliding element 251), by rotating the screw 246 in the state in which the nut 249 is loosened. Note that the center of the pin 250 coincides with the center of the connection pin 233 in the state in which the pin 250 (sliding element 251) is moved to the lowermost side. Then, the female thread body 247 (sliding element 251) can be fixed by fastening the nut 249.

In accordance with the structure mentioned above, the connection rod 232 vertically reciprocates and laterally oscillates simultaneously on the basis of the rotation of the rotation shaft 29 (the rotation in the direction of an arrow E in FIG. 11). As a result, since the connection rod 232 makes the connection pin 233 vertically reciprocate, it is possible to vertically slide the slide 220 along the guide rail 219. Further, it is possible to laterally oscillate the cutter mounting oscillating arm 223 centering around the pivot shaft 222 via the sliding element 251 on the basis of the oscillation of the connection rod 232. In other words, it is possible to set the locus of the leading end of the cutter 24 mounted to the cutter mounting oscillating arm 223 to a predetermined shape (refer to an alternate long and short dash line F in FIG. 11) which is different between an outward route and a homeward route and is a line symmetrical and bulgy endless in a front view (as seen from a state of normally facing to the front wall 3) with respect to a line in parallel with the moving direction of the slide 220 (in other words, a line orthogonal to the centerline of the wire rod passage 7 of the final wire rod guide 6), by sliding the slide 220 and oscillating the cutter mounting oscillating arm 223 on the basis of an actuation of the actuating apparatus 26. Further, it is possible to change a lateral oscillating amount of the cutter mounting oscillating arm 223 by vertically changing the fixed position of the sliding element 251 along the guide passage 236, in other words, by changing the distance from the eccentric pin 231, whereby it is possible to adjust the shape (bulging degree) of the locus of the leading end of the cutter 24. In this case, when the center of the sliding element 251 coincides with the center of the connection pin 233, the cutter mounting oscillating arm 223 is not absolutely oscillated.

Further, it is possible to shift the locus of the leading end of the cutter 24 in parallel in the lateral direction, by changing a position of the block member 237 in the lateral direction between the two protruding pieces 240.

Fourth Embodiment

A detailed description will be given below of a fourth embodiment of a wire rod cutting apparatus in accordance with the present invention referring to the drawings.

Figure 15:
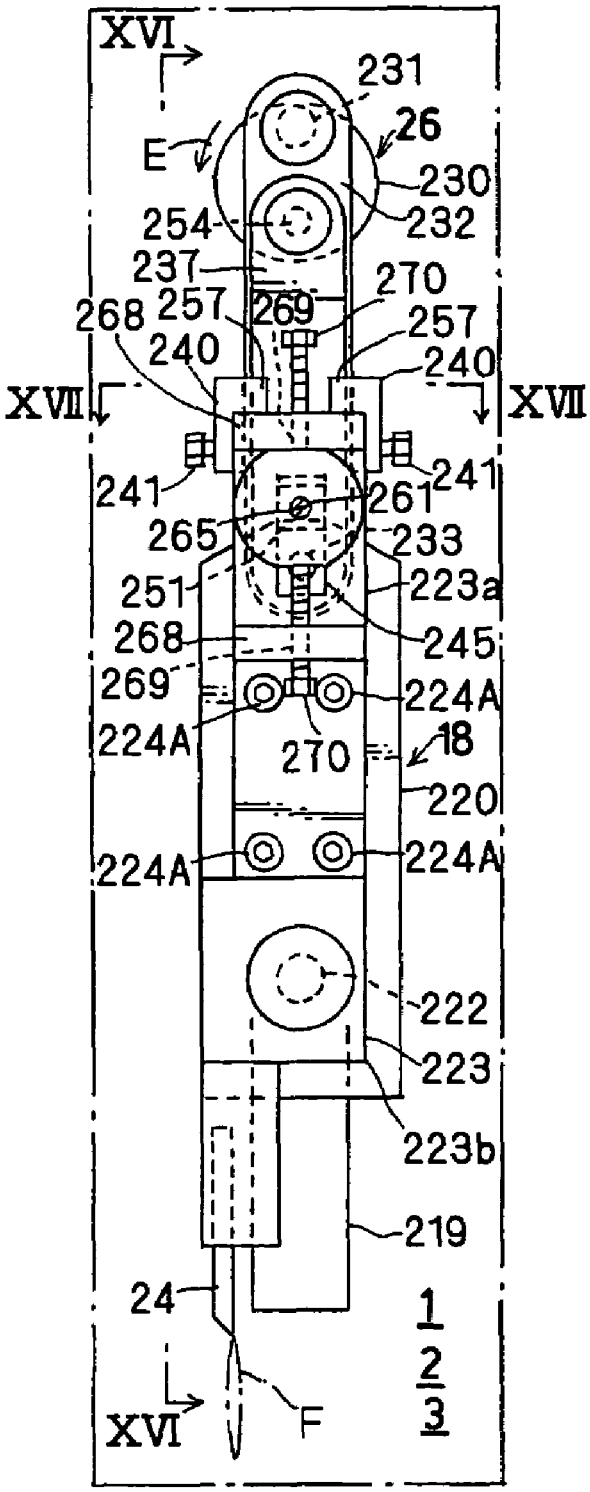
FIG. 15 is a front view of a main portion showing a fourth embodiment of a wire rod cutting apparatus in accordance with the present invention.
Figure 16:
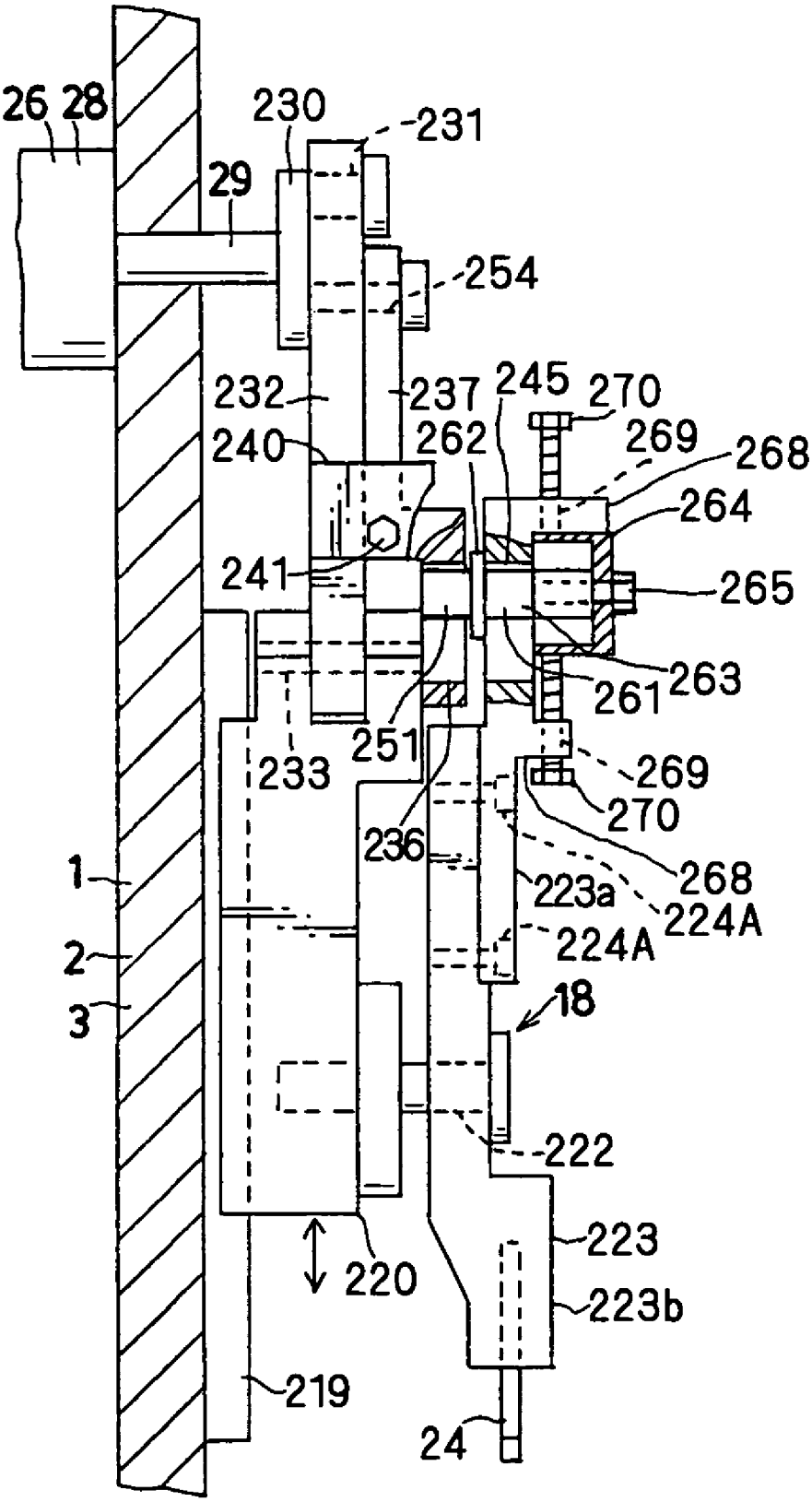
FIG. 16 is a cross sectional view along a line XVI-XVI in FIG. 15.
Figure 17:
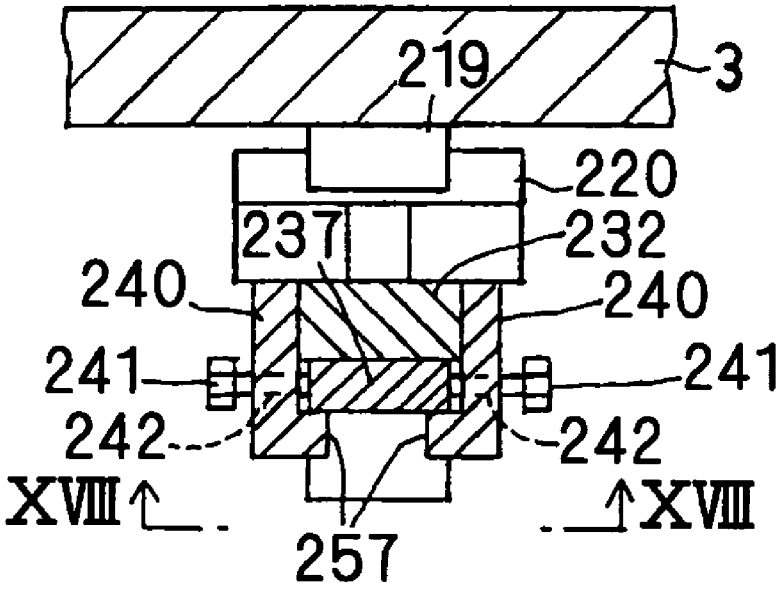
FIG. 17 is a partially omitted cross sectional view along a line XVII-XVII in FIG. 15.
Figure 18:
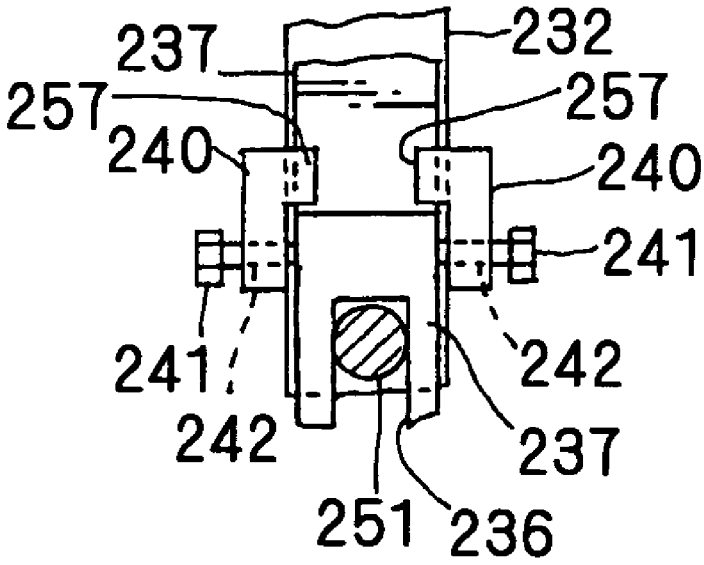
FIG. 18 is a cross sectional view along a line XVIII-XVIII in FIG. 17.

FIG. 15 is a front view of a main portion showing the fourth embodiment of a wire rod cutting apparatus in accordance with the present invention, FIG. 16 is a cross sectional view along a line XVI-XVI in FIG. 15, FIG. 17 is a partially omitted cross sectional view along a line XVII-XVII in FIG. 15, and FIG. 18 is a cross sectional view along a line XVIII-XVIII in FIG. 17. In addition, in the following description of the fourth embodiment, front means the top side of a paper surface in FIG. 15, rear means the back side thereof, left means the left side in FIG. 15 and right means the right side in FIG. 15.

As shown in FIG. 16, an upper end of the block member 237 having the guide passage 236 is supported by a supporting shaft 254 provided in the connection rod 232 and having an axis directed to the longitudinal direction. That is, the block member 237 is provided in the connection rod 232 so as to freely oscillate in the lateral direction. As shown in FIG. 17 and FIG. 18, the connection rod 232 is provided with a pair of right and left protruding pieces 240. The block member 237 is made to be positioned between the two protruding pieces 240. Moreover, each protruding piece 240 is provided with a suppressing piece 257 for preventing the block member 237 from being lifted in an upward and forward direction. In the screw hole 242 of each protruding piece 240, a bolt 241 is screwed and fitted. In accordance with the structure mentioned above, it is possible to fix the block member 237 by oscillating both of the block members 237 laterally in the state in which both of the bolts 214 are loosened, and adjusting the position of the block member 237 with respect to the connection rod 232 and thereafter fastening the bolt 241.

Along the slit 245, a sliding member 261 is provided so as to freely slide. The sliding member 261 has a sliding element 251 which is fitted in the guide passage 236 with no play in its width direction, a flange 262 provided in the front portion of the sliding element 251, a moving piece 263 which is provided in the flange 262 so as to protrude to the front side and fit in the slit 245, a cap 264 which covers the front end portion of the moving piece 263, and a bolt 265 which is screwed and fitted in a screw hole formed in the moving piece 263 through a through hole formed by penetrating the cap 264 in the longitudinal direction.

In an upper portion 223*a* of the cutter mounting oscillating arm 223, a pair of upper and lower protruding pieces 268 are provided. The cap 264 is made to be positioned between the two protruding pieces 268. In the two protruding pieces 268, screw holes 269 each having an axis opposing to the cap 264 and directed to the vertical direction are formed respectively. In both of the screw holes 269, bolts 270 are screwed and fitted respectively, so that the front ends of the both bolts 270 come into contact with the cap 264.

In accordance with the structure mentioned above, by loosening the bolt 265 and both of the bolts 270 and then adjusting the vertical position of sliding member 261 with respect to the upper portion 223*a* of the cutter mounting oscillating arm 223, and thereafter fastening the bolt 265 and both of the bolts 270, it is possible to fix the sliding member 261 to the cutter mounting oscillating arm 223.

Note that, similarly to the above described third Embodiment, it is possible to shift the locus of the leading end of the cutter 24 in parallel in the lateral direction by changing a position of the block member 237 in the lateral direction between the two protruding pieces 240.

As some modified examples of the above-mentioned third and fourth Embodiments, the following structures may be adopted.

The sliding element 251 may be provided in the connection rod 232 allowing the sliding element 251 to change its position in the length direction of the connection rod 232, and a block member 237 having the guide passage 236 may be provided in the upper portion 223*a* of the cutter mounting oscillating arm 223, in the construction similar to the above-mentioned Embodiments.

The upper portion 223*a* (the member having the sliding element 251) of the cutter mounting oscillating arm 223 may be allowed to change its position in the lateral direction with respect to the lower portion 223*b* of the cutter mounting oscillating arm 223 and to be fixed at an optional position. Moreover, the upper portion 223*a* (the member having the sliding element 251) of the cutter mounting oscillating arm 223 may be supported by a supporting shaft having an axis directed to the longitudinal direction with respect to the lower portion 223*b* so as to allow the upper portion 223*a* to be fixed at an optional position. This allows the sliding element 251 to laterally change its position and to be fixed.

The tools include bending die, forming tool, and the like.

FIG. 19A through FIG. 19D are schematic views showing shapes and positions of the locus of the leading end of the cutter 24 of the wire rod cutting apparatus in accordance with the present invention.

Figure 19A:
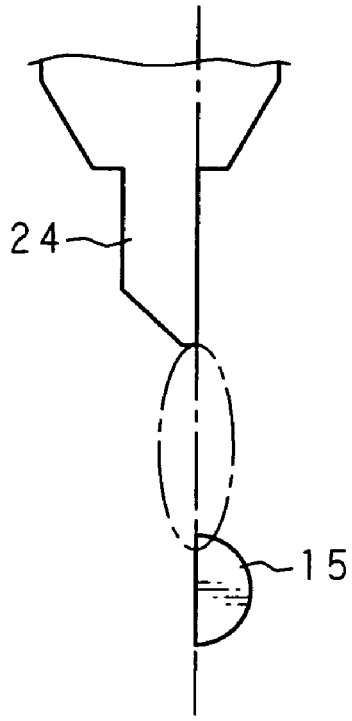
FIG. 19A through FIG. 19D are schematic views sowing shapes and positions of the locus of the leading end of the cutter of a wire rod cutting apparatus in accordance with the present invention.
Figure 19B:
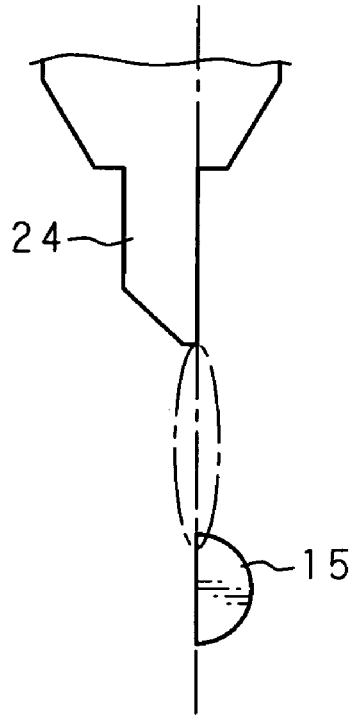
Figure 19C:
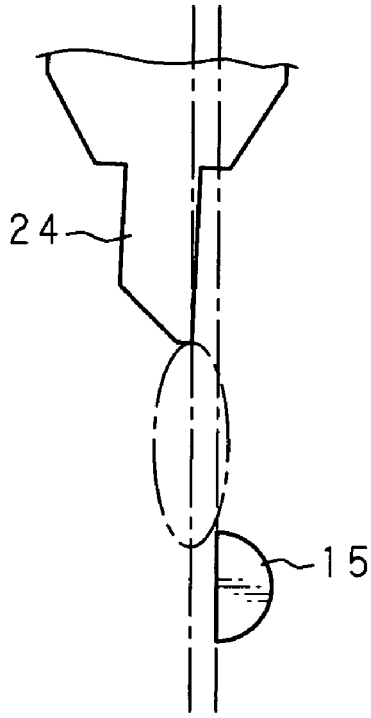
Figure 19D:
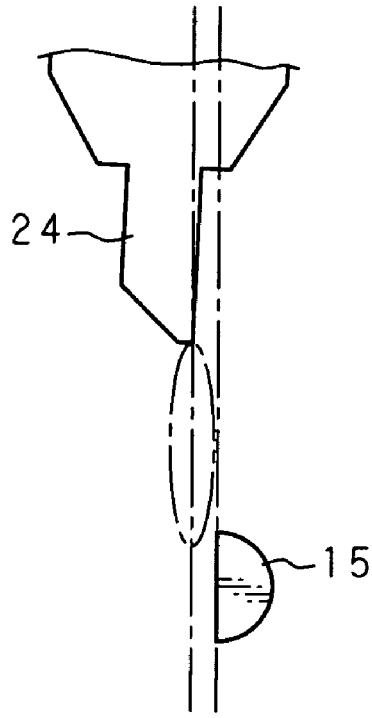

According to the first, third and fourth Embodiments of the wire rod cutting apparatus of a spring manufacturing machine of the present invention, as indicated by an alternate long and short dash line in FIG. 19A and FIG. 19B respectively, it is possible to adjust the shape (bulging degree, to be more specific) of the locus of the leading end of the cutter 24 which is line symmetrical with respect to a line orthogonal to the centerline of the wire rod passage 7 of the final wire rod guide 6 as an axis (centerline) of symmetry. Thus, since an approach angle of the leading end of the cutter 24 with respect to the core bar 15 can be varied, an angle by which the wire rod W is cut can be varied as a result. As a matter of course, it is necessary to use a core bar 15 having a slope surface 15*c* suitable for the locus of the leading end of the cutter 24. In other words, even in the case where a core bar 15 is replaced for the one having a different angle of the slope surface 15*c* so as to change the angle by which the wire rod W is cut, the wire rod cutting apparatus of the spring manufacturing machine of the present invention can easily adjust the shape of the locus of the leading end of the cutter 24 in accordance with the angle of the slope surface 15*c* of the replaced core bar 15.

According to the second, third and fourth Embodiments of the wire rod cutting apparatus of a spring manufacturing machine of the present invention, as indicated by an alternate long and short dash line in FIG. 19A and FIG. 19C, or FIG. 19B and FIG. 19D respectively, it is possible to shift the position of the locus of the leading end of the cutter 24 which is line symmetrical with respect to a line orthogonal to the centerline of the wire rod passage 7 of the final wire rod guide 6 as an axis of symmetry (centerline) (to be more specific, shift the position of the axis of symmetry, i.e., the centerline). Therefore, in a case where the centerline of the locus of the leading end of the cutter 24 does not coincides with the vertical surface 15*b* of the core bar 15, it is possible to make them easily coincide with each other. In other words, even in the case where a core bar 15 is replaced by the one having a different size (diameter), the wire rod cutting apparatus of the spring manufacturing machine of the present invention can easily shift the position of the center line of the locus of the leading end of the cutter 24 in accordance with the position of the vertical surface 15*b* of the replaced core bar 15. Needless to say, it is possible to shift the locus of the leading end of the cutter 24 in a direction opposite to the direction shown in FIG. 19C and FIG. 19D (to the right in the drawing).

According to the third and fourth Embodiments of the wire rod cutting apparatus of the spring manufacturing machine of the present invention, it is possible to adjust the shape (bulging degree) of the locus of the leading end of the cutter 24 as well as to shift the position (the position of the centerline) of the same.

The wire rod cutting apparatus of the spring manufacturing machine of the present invention can be used for cutting the wire rod serving as the raw material of the various products.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds there-of are therefore intended to be embraced by the claims.

The invention claimed is:

1. A wire rod cutting apparatus of a spring manufacturing machine for manufacturing a spring by discharging a wire rod to a wire rod processing space provided in front of a front wall of a machine casing from a final wire rod guide provided in said front wall, and applying a predetermined process to the wire rod which is discharged to said wire rod processing space or is being discharged to said wire rod processing space, by a tool which protrudes or is protruding to said wire rod processing space, comprising:

a slide which is slidably provided in said front wall so as to slide in the direction orthogonal to a center line of a wire rod passage of said final wire rod guide;

a cutter mounting oscillating arm which is provided in said slide so as to freely oscillate by a pivot shaft having an axis directed in the longitudinal direction; and an actuating apparatus which slides said slide and oscillates said cutter mounting oscillating arm;

wherein said actuating apparatus has: a rotation shaft which is in parallel to said pivot shaft; an eccentric pin which is directly or indirectly provided in said rotation shaft, is eccentric from the center of said rotation shaft and is in parallel to said rotation shaft; a connection rod which is pivotally attached to said eccentric pin in one end; and a connection pin which is provided in said slide in parallel to said eccentric pin and is pivotally attached to the other end of said connection rod; and said wire rod cutting apparatus comprises:

a sliding element provided at either one of said connection rod and a portion, opposing to said connection rod, of said cutter mounting oscillating arm;

a guide groove, provided on the other of said connection rod and said portion of said cutter mounting oscillating arm, and formed so that said sliding element is fitted therein with no play in the width direction, and one end in the length direction thereof is directed to said eccentric pin and the other end thereof is directed to said pivot shaft; and means for allowing said sliding element to change a position so as to change a distance from said pivot shaft by sliding said sliding element along said guide groove, and for fixing said sliding element at an optional position.

2. A wire rod cutting apparatus of a spring manufacturing machine for manufacturing a spring by discharging a wire rod to a wire rod processing space provided in front of a front wall of a machine casing from a final wire rod guide provided in said front wall, and applying a predetermined process to the wire rod which is discharged to said wire rod processing space or is being discharged to said wire rod processing space, by a tool which protrudes or is protruding to said wire rod processing space, comprising:

a slide which is slidably provided in said front wall so as to slide in the direction orthogonal to a center line of a wire rod passage of said final wire rod guide;

a cutter mounting oscillating arm which is provided in said slide so as to freely oscillate by a pivot shaft having an axis directed in the longitudinal direction; and an actuating apparatus which slides said slide and oscillates said cutter mounting oscillating arm;

wherein said actuating apparatus has: a rotation shaft which is in parallel to said pivot shaft; an eccentric pin which is directly or indirectly provided in said rotation shaft, is eccentric from the center of said rotation shaft and is in parallel to said rotation shaft; a connection rod which is pivotally attached to said eccentric pin in one end; and a connection pin which is provided in said slide in parallel to said eccentric pin and is pivotally attached to the other end of said connection rod; and said wire rod cutting apparatus comprises:

a protrusion provided at either one of said connection rod and a portion, opposing to said connection rod, of said cutter mounting oscillating arm;

a guide member, provided on the other of said connection rod and said portion of said cutter mounting oscillating arm, and forming a guide groove in which said protrusion is fitted with no play in the vertical direction; and means for allowing said protrusion to change a position in the lateral direction with respect to either one, on which said protrusion is provided, of said connection rod and said cutter mounting oscillating arm, and for fixing said protrusion at an optional position.

3. The wire rod cutting apparatus of a spring manufacturing machine as set forth in claim 2, wherein at least one of said protrusion and said guide member is detachable from a member to which said protrusion or said guide member is attached, and an oscillation preventing member for preventing oscillation of said cutter mounting oscillating arm is detachably provided in said slide.

4. A wire rod cutting apparatus of a spring manufacturing machine for manufacturing a spring by discharging a wire rod to a wire rod processing space provided in front of a front wall of a machine casing from a final wire rod guide provided in said front wall, and applying a predetermined process to the wire rod which is discharged to said wire rod processing space or is being discharged to said wire rod processing space, by a tool which protrudes or is protruding to said wire rod processing space, comprising:

a slide which is slidably provided in said front wall so as to slide in the direction orthogonal to a center line of a wire rod passage of said final wire rod guide;

a cutter mounting oscillating arm which is provided in said slide so as to freely oscillate by a pivot shaft having an axis directed in the longitudinal direction; and an actuating apparatus which slides said slide and oscillates said cutter mounting oscillating arm;

wherein said actuating apparatus has: a rotation shaft which is in parallel to said pivot shaft; an eccentric pin which is directly or indirectly provided in said rotation shaft, is eccentric from the center of said rotation shaft and is in parallel to said rotation shaft; a connection rod which is pivotally attached to said eccentric pin in one end; and a connection pin which is provided in said slide in parallel to said eccentric pin and is pivotally attached to the other end of said connection rod; and said wire rod cutting apparatus comprises:

a sliding element provided at either one of said connection rod and a portion, opposing to said connection rod, of said cutter mounting oscillating arm;

a block member, provided on the other of said connection rod and said portion of said cutter mounting oscillating arm, in which a guide passage is formed, said sliding element being fitted in said guide passage with no play in the width direction, and one end in the length direction of said guide passage being directed to said eccentric pin and the other end of the same being directed to said pivot shaft;

means for allowing said sliding element to change a position so as to change a distance from said pivot shaft by moving said sliding element along said guide passage, and for fixing said sliding element at an optional position within a range of a length of said guide passage; and means for allowing said block member to laterally change a position with respect to either one, on which said block member is provided, of said connection rod and said cutter mounting oscillating arm, and for fixing said block member at an optional position.

5. A wire rod cutting apparatus of a spring manufacturing machine for manufacturing a spring by discharging a wire rod to a wire rod processing space provided in front of a front wall of a machine casing from a final wire rod guide provided in said front wall, and applying a predetermined process to the wire rod which is discharged to said wire rod processing space or is being discharged to said wire rod processing space, by a tool which protrudes or is protruding to said wire rod processing space, comprising:

a slide which is slidably provided in said front wall so as to slide in the direction orthogonal to a center line of a wire rod passage of said final wire rod guide;

a cutter mounting oscillating arm which is provided in said slide so as to freely oscillate by a pivot shaft having an axis directed in the longitudinal direction; and an actuating apparatus which slides said slide and oscillates said cutter mounting oscillating arm;

wherein said actuating apparatus has: a rotation shaft which is in parallel to said pivot shaft; an eccentric pin which is directly or indirectly provided in said rotation shaft, is eccentric from the center of said rotation shaft and is in parallel to said rotation shaft; a connection rod which is pivotally attached to said eccentric pin in one end; and a connection pin which is provided in said slide in parallel to said eccentric pin and is pivotally attached to the other end of said connection rod; and said wire rod cutting apparatus comprises:

a sliding element provided at either one of said connection rod and a portion, opposing to said connection rod, of said cutter mounting oscillating arm;

a block member, provided on the other of said connection rod and said portion of said cutter mounting oscillating arm, in which a guide passage is formed, said sliding element being fitted in said guide passage with no play in the width direction, and one end in the length direction of said guide passage being directed to said eccentric pin and the other end of the same being directed to said pivot shaft;

means for allowing said sliding element to change a position so as to change a distance from said pivot shaft by moving said sliding element along said guide passage, and for fixing said sliding element at an optional position within a range of a length of said guide passage;

a supporting shaft having an axis directed to the longitudinal direction, and attached to either one, on which said block member is provided, of said connection rod and said cutter mounting oscillating arm; and means for allowing said block member to laterally oscillate with respect to either one, on which said block member is provided, of said connection rod and said cutter mounting oscillating arm by supporting one end of said block member by said supporting shaft, and for fixing the oscillation of said block member centering around said supporting shaft at an optional position.

6. A wire rod cutting apparatus of a spring manufacturing machine for manufacturing a spring by discharging a wire rod to a wire rod processing space provided in front of a front wall of a machine casing from a final wire rod guide provided in said front wall, and applying a predetermined process to the wire rod which is discharged to said wire rod processing space or is being discharged to said wire rod processing space, by a tool which protrudes or is protruding to said wire rod processing space, comprising:

a slide which is slidably provided in said front wall so as to slide in the direction orthogonal to a center line of a wire rod passage of said final wire rod guide;

a cutter mounting oscillating arm which is provided in said slide so as to freely oscillate by a pivot shaft having an axis directed in the longitudinal direction; and an actuating apparatus which slides said slide and oscillates said cutter mounting oscillating arm;

wherein said actuating apparatus has: a rotation shaft which is in parallel to said pivot shaft; an eccentric pin which is directly or indirectly provided in said rotation shaft, is eccentric from the center of said rotation shaft and is in parallel to said rotation shaft; a connection rod which is pivotally attached to said eccentric pin in one end; and a connection pin which is provided in said slide in parallel to said eccentric pin and is pivotally attached to the other end of said connection rod; and said wire rod cutting apparatus comprises:

a sliding element provided at either one of said connection rod and a portion, opposing to said connection rod, of said cutter mounting oscillating arm;

a block member, provided on the other of said connection rod and said portion of said cutter mounting oscillating arm, in which a guide passage is formed, said sliding element being fitted in said guide passage with no play in the width direction, and one end in the length direction of said guide passage being directed to said eccentric pin and the other end of the same being directed to said pivot shaft;

means for allowing said sliding element to change a position so as to change a distance from said pivot shaft by sliding said sliding element along said guide passage, for allowing said sliding element to laterally change a position with respect to either one, on which said block member is provided, of said connection rod and said cutter mounting oscillating arm, and for fixing said sliding element at an optional position.

* * * * *